US008006976B2

(12) United States Patent
Suzuki et al.

(10) Patent No.: US 8,006,976 B2
(45) Date of Patent: Aug. 30, 2011

(54) PAPER FEED SYSTEM

(75) Inventors: Masao Suzuki, Ami-machi (JP); Hitoshi Arai, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 139 days.

(21) Appl. No.: 12/187,674

(22) Filed: Aug. 7, 2008

(65) Prior Publication Data

US 2009/0039588 A1 Feb. 12, 2009

(30) Foreign Application Priority Data

Aug. 10, 2007 (JP) ..... 2007-208930

(51) Int. Cl.
*B65H 7/02* (2006.01)
*B65H 5/34* (2006.01)

(52) U.S. Cl. ..... 271/270; 271/265.01

(58) Field of Classification Search ..... 271/270, 271/265.01
See application file for complete search history.

(56) References Cited

U.S. PATENT DOCUMENTS 5,119,146 A * 6/1992 Nobumori et al. ..... 399/396
6,112,655 A * 9/2000 Suzuki et al. ..... 101/118
6,227,534 B1 * 5/2001 Schoedinger et al. ..... 271/114
6,298,778 B1 * 10/2001 Onodera et al. ..... 101/232
7,380,789 B2 * 6/2008 Murrell et al. ..... 271/270
7,384,042 B2 * 6/2008 Sakakibara et al. ..... 271/270
7,559,549 B2 * 7/2009 Clark et al. ..... 271/270
7,651,090 B2 * 1/2010 Satoh et al. ..... 271/265.02
2003/0057639 A1 * 3/2003 Chapman et al. ..... 271/270
2006/0202411 A1 * 9/2006 Yasui et al. ..... 271/270
2008/0258380 A1 * 10/2008 Okumura et al. ..... 271/258.01

FOREIGN PATENT DOCUMENTS

JP 10035910 2/1998

* cited by examiner

*Primary Examiner* — Kaitlin S Joerger
*Assistant Examiner* — Patrick Cicchino
(74) *Attorney, Agent, or Firm* — Brian M. McGuire; Matthew K. Ryan; Frommer Lawrence & Haug LLP

(57) ABSTRACT

In a paper feed system where a first paper feed mechanism takes out and transfers one by one a plurality of papers placed on a paper feed table in a stack and a second paper feed mechanism transfers the papers transferred by the first paper feed mechanism to an image forming section at a predetermined timing. A paper edge detector is provided between the first and second paper feed mechanisms to detect an edge of the paper, and the first paper feed mechanism is controlled to transfer the papers at a first speed and then at a second speed not higher than the first speed when the paper edge detector detects the leading edge of the paper, the second speed being determined on the basis of the timing at which the leading edge of the paper is detected.

12 Claims, 35 Drawing Sheets

Cn2H
C2r
C2s
C1s
C2h
COUNT OF PRINT PULSE
TRANSFER SPEED: Vg [mm/s]
0
100
200
300
400
500
600
700
800
620
576
565
565
532
565
565
565

PAPER FEED SYSTEM

BACKGROUND OF THE INVENTION

1. Field of the Invention

This invention relates to a paper feed system where a plurality of papers placed on a paper feed table are taken out and transferred one by one by a first paper feed mechanism and delivered to an image forming section by a second paper feed mechanism at a predetermined time.

2. Description of the Related Art

There have been proposed various paper feed systems to be installed in printers such as ink jet printers and stencil printers.

In such a paper feed system, generally, a plurality of papers placed on a paper feed table are taken out one by one by a pair of rotating paper feed rollers, transferred to a resist roller and delivered by the resist roller to an image forming section comprising a line head which discharges the ink and a printing drum.

In such a paper feed system, in order to overcome the problem of inclination of the papers due to an oblique feed of the papers in the paper transfer step, the paper feed rollers are kept rotated for a while even if the leading edge reaches the resist roller before the resist roller is started to be rotated. Accordingly, in such a paper feed system, the paper transferred from the paper feed table to the resist roller is sagged in the direction of transfer between the paper feed rollers and the resist roller while the resist roller transfers it in the image forming section. By suitably sagging the papers in this manner, the inclination of the papers due to an oblique feed of the papers in the paper transfer step can be overcome.

In such a conventional paper feed system, the paper feed rollers are generally connected to a driving source by way of an electromagnetic clutch, and the electromagnetic clutch is engaged each time one paper is taken out to permit the paper feed rollers to rotate by a predetermined angle.

Further, for example, if paper feed rollers are driven to rotate for only a predetermined angle even when the printing speed differs at an image forming section, faults will arise in paper feed and conveyance. Taking this fact into consideration, Japanese Unexamined Patent Publication No. 10(1998)-035910 proposes a paper feed apparatus in which the angle for which the paper feed roller is driven to rotate is varied, according to the printing speed at an image forming section.

In such a paper feed system, the waiting positions of the papers fluctuate depending on the manner in which the papers are set on the paper feed table 11 as shown in FIG. 4. In normal use, the fluctuation in the waiting positions of the papers is about 15 mm on the upstream side and cannot be defined on the downstream side depending on the degree of the feed of superimposed papers. Accordingly, there is a probability that the waiting positions of the papers fluctuate in the range shown by the arrow in FIG. 5. When the printing papers different from each other in waiting position are transferred in the same manner, the amount of the sagging cannot be uniform and the paper supply timing to the image forming section differs from paper to paper, whereby the position of the image formed by the image forming section is shifted.

Though taking into account the printing speed in the image forming section, the paper feed system disclosed in Japanese Unexamined Patent Publication No. 10(1998)-035910 does not take into account the fluctuation in the waiting positions.

SUMMARY OF THE INVENTION

In view of the observations and description, the primary object of the present invention is to provide a paper feed system which can keep the amount of the sagging substantially uniform even if there is a fluctuation in waiting positions of the printing papers.

Further, though, in such a paper feed system, when the resist roller delivers the papers to the image forming section, it is necessary to conform the paper transfer speed of the resist roller to that in the image forming section, the intervals between papers depends upon the paper transfer speed in the image forming section when the paper transfer speed is always equal to that in the image forming section, and the intervals between papers are widened when the paper transfer speed in the image forming section is relatively slow, which lowers the productivity.

Another object of the present invention is to provide a paper feed system which can more improve the productivity.

In accordance with the present invention, there is provided a first paper feed system comprising a first paper feed mechanism which takes out and transfers one by one a plurality of papers placed on a paper feed table in a stack and a second paper feed mechanism which transfers the papers transferred by the first paper feed mechanism to an image forming section at a predetermined timing, a paper edge detector being provided between the first and second paper feed mechanisms to detect an edge of the paper, a paper feed control section which controls the first paper feed mechanism to transfer the papers at a first speed and then at a second speed not higher than the first speed when the paper edge detector detects a leading edge of the paper, and the second speed being determined on the basis of the timing at which the leading edge of the paper is detected.

In the first paper feed system, the paper feed control section may control the second paper feed mechanism to transfer the paper at a third speed for a predetermined time interval and then at a fourth speed equal to the paper transfer speed in the image forming section, the third speed being higher than the fourth speed.

Further, in the first paper feed system, the paper feed control section may control the first paper feed mechanism to start transferring the next paper from the time at which the trailing edge of the preceding paper transferred by the second paper feed mechanism is detected by the paper edge detector.

Further, in the first paper feed system, the paper feed control section may stop the second paper feed mechanism from a predetermined time after the time at which the trailing edge of the preceding paper transferred by the second paper feed mechanism passes by the second paper feed mechanism to the time at which the transfer of the next paper by the first paper feed mechanism is ended.

Further, in the first paper feed system, the paper feed control section may control the first and second paper feed mechanisms to start the transfer of the next paper by the second paper feed mechanism from a predetermined time after the time at which the transfer of the paper by the first paper feed mechanism is ended.

Further, in the first paper feed system, the image forming section may comprise an image forming pulse generating means which generates a pulse signal according to transfer of the paper in the image forming section and the paper feed control section may measure the time at which the paper edge detector detects the leading edge of the paper on the basis of the pulse signal output from the image forming pulse generating means.

Further, in the first paper feed system, the paper feed control section may control the timing at which the first and second paper feed mechanisms are driven on the basis of the count of the pulse signals generated from the image forming pulse generating means.

Further, the pulse signals generated from the image forming pulse generating means may be a print pulse signal for controlling a printing timing in the image forming section.

Further, the paper feed control section may determine that there is generated a paper transfer-error when the count of the pulse signals generated from the image forming pulse generating means is not smaller than a predetermined value at the time when the paper edge detector detects a leading edge of the paper.

In accordance with the present invention, there is provided a second paper feed system comprising a first paper feed mechanism which takes out and transfers one by one a plurality of papers placed on a paper feed table in a stack and a second paper feed mechanism which transfers the papers transferred by the first paper feed mechanism to an image forming section at a predetermined timing, a first paper edge detector being provided between the first and second paper feed mechanisms to detect an edge of the paper, a second paper edge detector being provided between the first and second paper feed mechanisms, at a position closer to the second paper feed mechanism than the first paper edge detector, for detecting an edge of the paper, a paper feed control section controlling the first paper feed mechanism to transfer the papers at a first speed and then at a second speed not higher than the first speed when the second paper edge detector detects a leading edge of the paper, and the second speed being determined on the basis of the timings at which the leading edge of the paper is detected by the first and second paper edge detectors.

In the second paper feed system, the paper feed control section may control the second paper feed mechanism to transfer the paper at a third speed for a predetermined time interval and then at a fourth speed equal to the paper transfer speed in the image forming section, the third speed being higher than the fourth speed.

Further, in the second paper feed system, the paper feed control section may control the first paper feed mechanism to start transferring the next paper from the time at which the trailing edge of the preceding paper transferred by the second paper feed mechanism is detected by the first paper edge detector.

Further, in the second paper feed system, the paper feed control section may stop the second paper feed mechanism from a predetermined time after the time at which the trailing edge of the preceding paper transferred by the second paper feed mechanism passes by the second paper feed mechanism to the time at which the transfer of the next paper by the first paper feed mechanism is ended.

Further, in the second paper feed system, the paper feed control section may control the first and second paper feed mechanisms to start the transfer of the next paper by the second paper feed mechanism from a predetermined time after the time at which the transfer of the paper by the first paper feed mechanism is ended.

Further, in the second paper feed system, the image forming section may comprise an image forming pulse generating means which generates a pulse signal according to transfer of the paper in the image forming section and the paper feed control section may measure the time at which the first and second paper edge detectors detect the leading edge of the paper on the basis of the pulse signal output from the image forming pulse generating means.

Further, in the second paper feed system, the paper feed control section may control the timing at which the first and second paper feed mechanisms are driven on the basis of the count of the pulse signals generated from the image forming pulse generating means.

Further, in the second paper feed system, the first paper feed mechanism may further comprise a first paper feed mechanism image forming pulse generating means which generates a pulse signal according to transfer of the paper in the first paper feed mechanism while the paper feed control section may determine the second speed on the basis of a transfer ratio of the first paper feed mechanism by obtaining the transfer ratio on the basis of the difference between the counts of the pulse signals generated by the first paper feed mechanism image forming pulse generating means at the time when the leading edge of the paper is detected by the first paper edge detector and at the time when the leading edge of the paper is detected by the second paper edge detector.

Further, in the second paper feed system, the paper feed control section may calculate the transfer ratio by the papers to be transferred.

Further, the pulse signals generated from the image forming pulse generating means may be a print pulse signal for controlling a print timing in the image forming section.

Further, the paper feed control section may determine that there is generated a paper transfer-error when the count of the pulse signals generated from the image forming pulse generating means is not smaller than a predetermined value at the time when the second paper edge detector detects a leading edge of the paper.

In accordance with the first paper feed system of the present invention, since in the system where a plurality of papers placed on a paper feed table in a stack are taken out and transferred one by one by the first paper feed mechanism and the papers transferred by the first paper feed mechanism are transferred to an image forming section at a predetermined timing by the second paper feed mechanism, a paper edge detector is provided between the first and second paper feed mechanisms to detect an edge of the paper, and the first paper feed mechanism is controlled to transfer the papers at a first speed and then at a second speed not higher than the first speed when the paper edge detector detects the leading edge of the paper, the second speed being determined on the basis of the timing at which the leading edge of the paper is detected, the amount of sagging described above can be held constant irrespective of the waiting positions of the papers on the paper feed table, whereby images can be formed in a suitable position of the papers in the image forming section.

In accordance with the first paper feed system of the present invention, since the papers are transferred at a first speed and then at a second speed not higher than the first speed, the sound of the paper impacting the second paper feed mechanism can be reduced.

Further, in accordance with the first paper feed system of the present invention, the paper interval can be narrowed and the productivity can be improved when the second paper feed mechanism transfers the paper at the third speed for a predetermined time interval and then at the fourth speed equal to the paper transfer speed in the image forming section, the third speed being set higher than the fourth speed.

Further, in accordance with the first paper feed system of the present invention, it is unnecessary to know the length of the paper in advance. Accordingly, it is not necessary to provide a length detecting system or a data transfer system whereby the cost can be reduced.

Further, in accordance with the first paper feed system of the present invention, even if there are mixed different paper lengths, the papers can be delivered to the image forming section at predetermined paper intervals.

Further, in the first paper feed system, when the first paper feed mechanism starts transferring the next paper from the time at which the trailing edge of the preceding paper transferred by the second paper feed mechanism is detected by the paper edge detector, the papers can be transferred in sequence without impact of trailing edge of the preceding paper against the leading edge of the next paper and reduction in productivity.

Further, in the first paper feed system, when the second paper feed mechanism is stopped from a predetermined time after the time at which the trailing edge of the preceding paper transferred by the second paper feed mechanism passes by the second paper feed mechanism to the time at which the transfer of the next paper by the first paper feed mechanism is ended, the paper can be provided with a suitable sag by transferring the paper with the first paper feed mechanism while the second paper feed mechanism is stopped.

Further, in the first paper feed system, when the paper feed control section controls the first and second paper feed mechanisms to start the transfer of the next paper by the second paper feed mechanism from a predetermined time after the time at which the transfer of the paper by the first paper feed mechanism is ended, the paper can be more smoothly delivered from the first paper feed mechanism to the second paper feed mechanism.

Further, in the first paper feed system, when the image forming section comprises an image forming pulse generating means which generates a pulse signal according to transfer of the paper in the image forming section to measure the time at which the leading edge of the paper is detected by the paper edge detector on the basis of the pulse signal output from the image forming pulse generating means, the time at which the leading edge of the paper is detected can be suitably measured by the use of the pulse signals generated by the image forming section without an additional timer or the like.

Further, in the first paper feed system, when the timing at which the first and second paper feed mechanisms are driven is controlled on the basis of the count of the pulse signals generated from the image forming pulse generating means, it is not necessary a scheduler nor to table various parameters such as the paper size, the printing speed and the like, whereby the data amount is very small and the system may be very small in memory capacity.

Further, when the pulse signals generated from the image forming pulse generating means are a print pulse signal for controlling a printing timing in the image forming section, the signals generated from the image forming pulse generating means may be used in common between the print pulse signal and the measuring signal at the time at which the leading edge of the paper is detected.

Further, when it is determined that there is generated a paper transfer-error when the count of the pulse signals generated from the image forming pulse generating means is not smaller than a predetermined value at the time when the paper edge detector detects a leading edge of the paper, the paper transfer-error can be suitably detected.

In accordance with the second paper feed system of the present invention, since in the system where a plurality of papers placed on a paper feed table in a stack are taken out and transferred one by one by the first paper feed mechanism and the papers transferred by the first paper feed mechanism are transferred to an image forming section at a predetermined timing by the second paper feed mechanism, a first paper edge detector is provided between the first and second paper feed mechanisms to detect an edge of the paper, a second paper edge detector is provided between the first and second paper feed mechanisms toward the second paper feed mechanism to detect an edge of the paper, and the first paper feed mechanism is controlled to transfer the papers at a first speed and then at a second speed not higher than the first speed when the second paper edge detector detects the leading edge of the paper, and the second speed being determined on the basis of the timings at which the leading edge of the paper is detected by the first and second paper edge detectors, the amount of sagging described above can be held constant irrespective of the waiting positions of the papers on the paper feed table, whereby images can be formed in a suitable position of the papers in the image forming section.

In accordance with the second paper feed system of the present invention, since the papers are transferred at a first speed and then at a second speed not higher than the first speed, the sound of the paper impacting the second paper feed mechanism can be reduced.

Further, in accordance with the second paper feed system of the present invention, the paper interval can be narrowed and the productivity can be improved when the second paper feed mechanism transfers the paper at the third speed for a predetermined time interval and then at the fourth speed equal to the paper transfer speed in the image forming section, the third speed being set higher than the fourth speed.

Further, in accordance with the second paper feed system of the present invention, it is unnecessary to know the length of the paper in advance. Accordingly, it is not necessary to provide a length detecting system or a data transfer system whereby the cost can be reduced.

Further, in accordance with the second paper feed system of the present invention, even if there are mixed different paper lengths, the papers can be delivered to the image forming section at predetermined paper intervals.

Further, in the second paper feed system, when the first paper feed mechanism starts transferring the next paper from the time at which the trailing edge of the preceding paper transferred by the second paper feed mechanism is detected by the first paper edge detector, the papers can be transferred in sequence without impact of trailing edge of the preceding paper against the leading edge of the next paper and reduction in productivity.

Further, in the second paper feed system, when the second paper feed mechanism is stopped from a predetermined time after the time at which the trailing edge of the preceding paper transferred by the second paper feed mechanism passes by the second paper feed mechanism to the time at which the transfer of the next paper by the first paper feed mechanism is ended, the paper can be provided with a suitable sag by transferring the paper with the first paper feed mechanism while the second paper feed mechanism is stopped.

Further, in the second paper feed system, when the first and second paper feed mechanisms are controlled to start the transfer of the next paper by the second paper feed mechanism from a predetermined time after the time at which the transfer of the paper by the first paper feed mechanism is ended, the paper can be more smoothly delivered from the first paper feed mechanism to the second paper feed mechanism.

Further, in the second paper feed system, when the image forming section comprises an image forming pulse generating means which generates a pulse signal according to transfer of the paper in the image forming section to measure the time at which the leading edge of the paper is detected by the paper edge detector on the basis of the pulse signal output from the image forming pulse generating means, the time at which the leading edge of the paper is detected can be suitably measured by the use of the pulse signals generated by the image forming section without an additional timer or the like.

Further, in the second paper feed system, when the timing at which the first and second paper feed mechanisms are driven is controlled on the basis of the count of the pulse signals generated from the image forming pulse generating means, it is not necessary a scheduler which governs troublesome timings nor to table various parameters such as the paper size, the printing speed and the like, whereby the data amount is very small and the system may be very small in memory capacity.

Further, in the second paper feed system, when the first paper feed mechanism further comprises a first paper feed mechanism image forming pulse generating means which generates a pulse signal according to transfer of the paper in the first paper feed mechanism while the paper feed control section determines the second speed on the basis of a transfer ratio of the first paper feed mechanism by obtaining the transfer ratio on the basis of the difference between the counts of the pulse signals generated by the first paper feed mechanism image forming pulse generating means at the time when the leading edge of the paper is detected by the first paper edge detector and at the time when the leading edge of the paper is detected by the second paper edge detector, the amount of sagging described above can be held constant irrespective of the transfer ratio even if the transfer ratio is changed due to difference in the paper quality.

Further, when the pulse signals generated from the image forming pulse generating means are a print pulse signal for controlling a printing timing in the image forming section, the signals generated from the image forming pulse generating means may be used in common between the print pulse signal and the measuring signal at the time at which the leading edge of the paper is detected.

Further, when it is determined that there is generated a paper transfer-error when the count of the pulse signals generated from the image forming pulse generating means is not smaller than a predetermined value at the time when the second paper edge detector detects a leading edge of the paper, the paper transfer-error can be suitably detected.

PREFERRED EMBODIMENT OF THE PRESENT INVENTION

Figure 1:
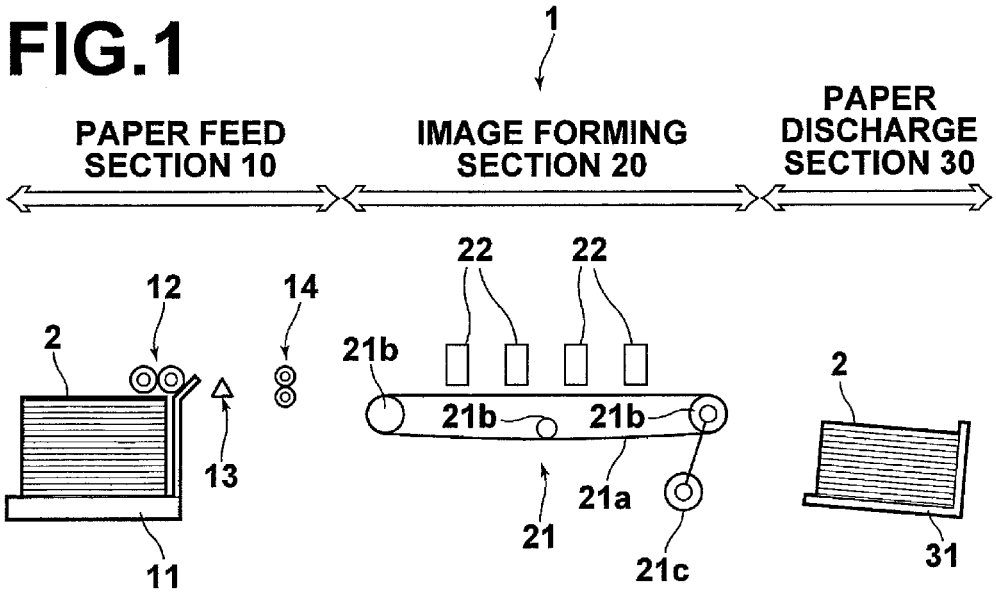
FIG. 1 is a view showing in brief an ink jet printer using a paper feed system in accordance with a first embodiment of the present invention.

An ink jet printer using a paper feed system in accordance with a first embodiment of the present invention will be described in detail with reference to the drawings, hereinbelow. Though the present invention is characterized in method of controlling the paper feed section in the ink jet printer to be described hereinbelow, the description will be first made on the ink jet printer. FIG. 1 is a view showing in brief the ink jet printer.

As shown in FIG. 1, the ink jet printer 1 comprises a paper feed section 10, an image forming section 20 and a paper discharge section 30.

The paper feed section 10 comprises a paper feed table 11 on which the papers 2 are mounted, a first paper feed mechanism 12 which takes out the papers 2 on the paper feed table 11 one by one from the uppermost one with pick-up rollers to transfer toward a second paper feed mechanism 14 to be described later to abut there against, a paper edge detector 13 which detects leading and trailing edges of the paper 2 fed out by the first paper feed mechanism 12, and the second paper feed mechanism 14 which delivers the paper 2 fed out by the first paper feed mechanism 12 to the image forming section 20 at predetermined paper intervals.

The image forming section 20 comprises a paper transfer means 21 which transfers the paper 2 delivered by the second paper feed mechanism 14, and a line head 22 which is disposed above the transferring face of the paper transfer means 21 to selectively discharge the ink toward the paper 2.

The paper transfer means 21 comprises a transfer belt 21*a* which transfers the papers 2, a transfer roller 21*b* and a drive motor (not shown) which rotates the transfer roller 21*b* and the paper 2 transferred from the paper feed section 10 is transferred therein to the image forming position attracting under a suction force or an electrostatic force, thereby holding a constant speed, and then to the paper discharge section 30 after the image is formed thereon.

In the ink jet printer 1, it is necessary a predetermined time to discharge the ink from the line head 22, and in order to form a two-dimensional image, it is necessary to progress the printing in synchronization with the paper transfer. Accordingly, the paper transfer speed must conform to the performance of the line head 22. Further, since it is necessary to form an image in synchronization with the paper transfer, a rotary encoder 21*c* which generates a print pulse signal in synchronization with the movement of the papers is mounted on the drive motor for driving the transfer roller 21*b*.

The line head 22 is for forming an image by selectively discharging the ink on the transferred paper 2. Further, the ink jet printer 1 of this embodiment comprises four color, i.e., K (black), C (cyan), M (magenta) and Y (yellow), heads to form a full-color image.

The paper discharge section 30 is provided with a paper discharge table 31 and the paper discharge table 31 stocks papers 2 printed in the image forming section 20 when necessary.

Figure 2:
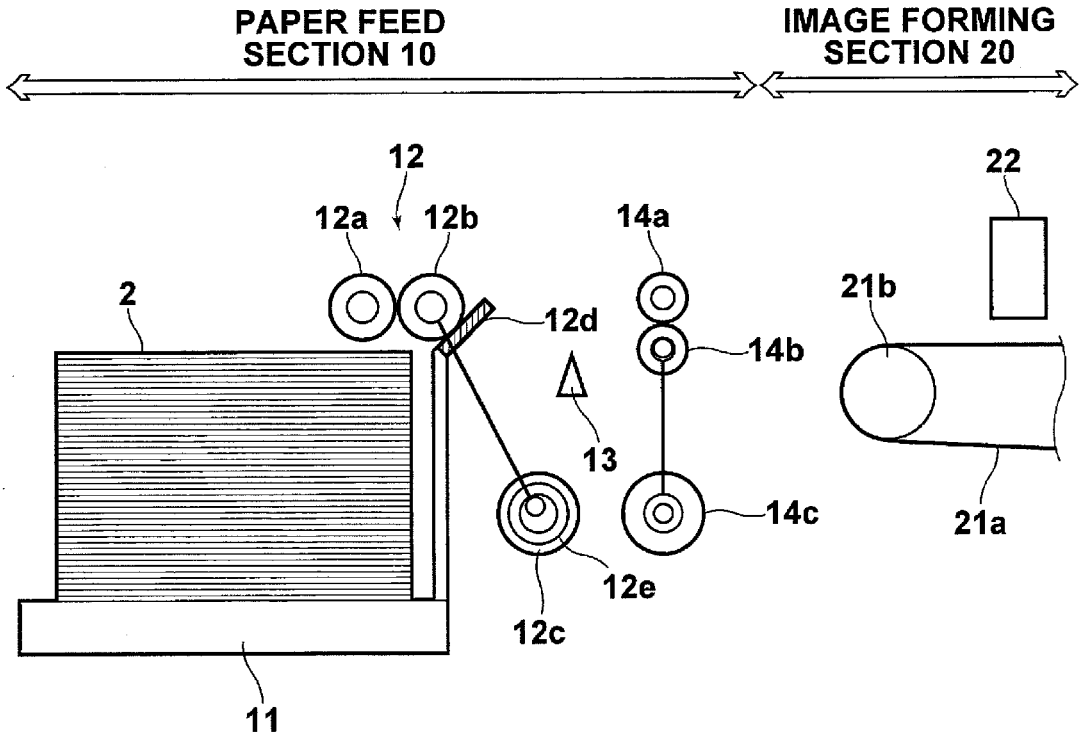
FIG. 2 is a view showing in detail the paper feed section of the ink jet printer shown in FIG. 1.

The paper feed section 10 in the ink jet printer 1 will be described in more detail with reference to FIG. 2, hereinbelow.

The first paper feed mechanism 12 of the paper feed section 10 comprises a pair of rubber rollers 12*a* and 12*b* and a first paper feed drive motor 12*c*, and though rotated in a paper transfer direction (left to right) by the first paper feed drive motor 12*c*, the rubber rollers 12*a* and 12*b* are of one-way structure where the rubber rollers 12*a* and 12*b* are idling and rotate pulled by the paper 2 when the paper 2 is transferred by the second paper feed mechanism 14. Further, the first paper feed drive motor 12*c* is provided with a rotary encoder 12*e* for the first paper feed mechanism 12 which generates pulse signals according to rotation of the rubber rollers 12*a* and 12*e*.

The upstream rubber roller 12*a* contacts the uppermost paper in the stack of papers on the paper feed table 11 at a predetermined pressure, and feeds the papers under its frictional force. The downstream rubber roller 12*b* cooperates with a separation plate 12*d* to pinch the papers therebetween. Since the separation plate 12*d* is fixed and is of a material which provides a frictional force larger than that between the papers even if a plurality of papers are supplied, papers closer to the separation plate 12*d* loses the transfer force, and only papers close to the rubber roller 12*b* is transferred.

The second paper feed mechanism 14 of the paper feed section 10 comprises a pair of transfer rollers 14*a* and 14*b* which nip therebetween the papers and a second paper feed drive motor 14*c*.

The second paper feed mechanism 14 can precisely control the amount of transfer different from the first paper feed mechanism 12, and takes an intermittent action for each paper to feed the paper in the image forming section 20 at a good timing.

The paper edge detector 13 is provided between the first and second paper feed mechanisms 12 and 14 and detects the leading edge and the trailing edge of the paper to be transferred to the second paper feed mechanism 14*b* from the first paper feed mechanism 12.

Figure 3:
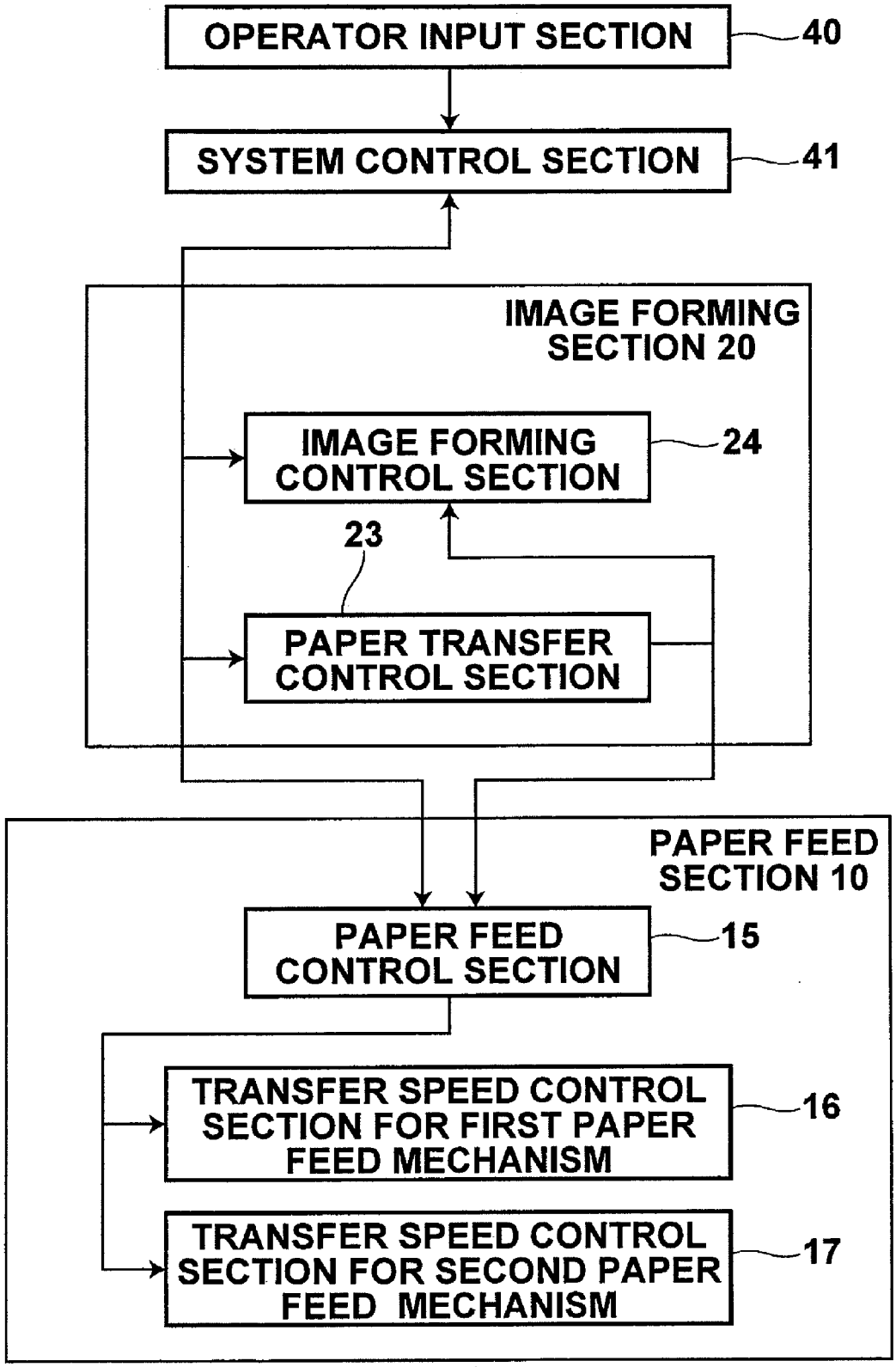
FIG. 3 is a view showing in detail the control system of the ink jet printer shown in FIG. 1.

The control system of the ink jet printer in accordance with this embodiment of the present invention will be described with reference to FIG. 3, hereinbelow.

The ink jet printer 1 in accordance with this embodiment of the present invention comprises an operator input section 40 which receives predetermined inputs from the operator such as the paper transfer speed in the image forming section 20, and a system control section 41 which receives information such as the paper transfer speed output from the operator input section 40 to output a control signal according to the information and controls the overall system.

The image forming section 20 comprises a paper transfer control section 23 which controls the drive motor for the transfer roller 21*b* of a paper transfer means 21 on the basis of the information on the paper transfer speed output from the system control section 41 and outputs the print pulse which is generated by the rotary encoder 21*c* described above and an image forming control section 24 which receives the print pulse output from the paper transfer control section 23 and controls discharge of the ink from the line head 22 on the basis of the print pulse.

The paper feed section 10 comprises a paper feed control section 15 which calculates the paper transfer speeds in the first and second paper feed mechanisms 12 and 14 on the basis of the information on the paper transfer speed output from the system control section 41 and the print pulse output from the paper transfer control section 23, a first paper feed mechanism control section 16 which controls the first paper feed drive motor 12*c* of the first paper feed drive mechanism 12 on the basis of a transfer speed instruction output from the paper feed control section 15 and a second paper feed mechanism control section 17 which controls the second paper feed drive motor 14*c* of the second paper feed drive mechanism 14 on the basis of the transfer speed instruction output from the paper feed control section 15.

The first and second paper feed mechanism control section 16 and 17 are for carrying out a PID control of a negative feedback system which has been known. Though will not be described in detail here, the transfer speed of the rubber rollers 12*a* and 12*b* or the transfer rollers 14*a* and 14*b* follows the transfer speed instruction output from the paper feed control section 15. Further, the first paper feed drive motor 12*c* of the first paper feed drive mechanism 12 and the second paper feed drive motor 14*c* of the second paper feed drive mechanism 14 are provided with a detector which detects the speed in order to carry out the PID control described above.

In such an ink jet printer 1, the first and second paper feed mechanisms 12 and 14 are controlled to correct the oblique running of the papers 2 by feeding the papers from the paper feed table by the first paper feed mechanism 12, transferring the same to the second paper feed mechanism 14 which has been stopped, continuing to transfer the same by the first paper feed mechanism 12 after the paper abuts against the second paper feed mechanism 14, thereby providing the paper with sagging, and subsequently starting driving the second paper feed mechanism 14 to feed the same to the image forming section 20.

Figure 4:
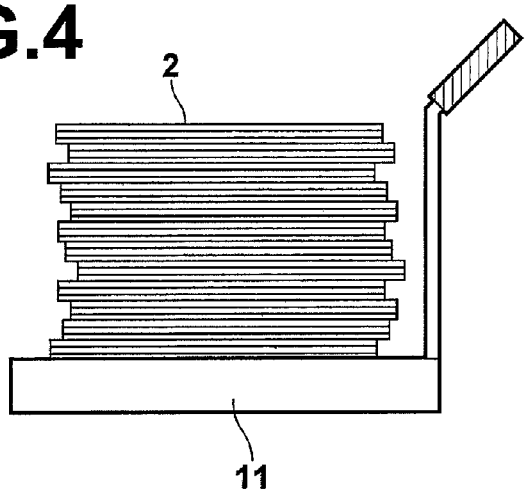
FIG. 4 is a view for describing the fluctuation of waiting positions in the papers on the paper feed table.
Figure 5:
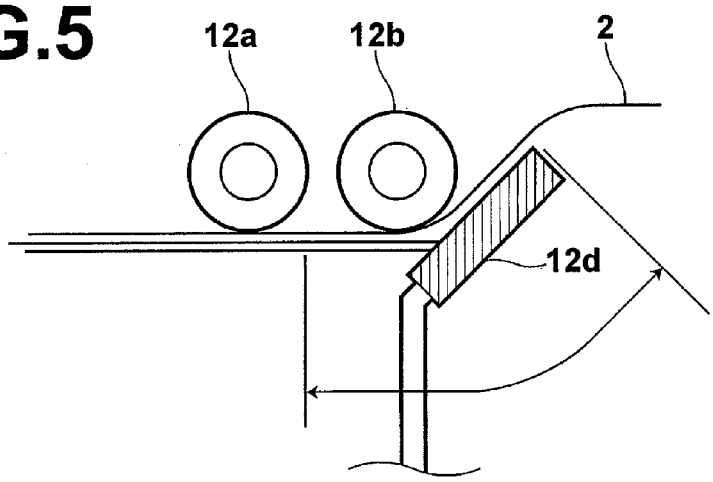
FIG. 5 is a view for describing the fluctuation of waiting positions in the papers on the paper feed table.

However, the waiting positions of the papers sometimes fluctuate from paper to paper, depending on the manner in which the papers are set on the paper feed table 11 as shown in FIG. 4. In the normal use, the fluctuation in the waiting positions of the papers is about 15 mm on the upstream side and cannot be defined on the downstream side depending on the degree of the feed of the superimposed papers. Accordingly, there is a probability that the waiting positions of the papers fluctuate in the range shown by the arrow in FIG. 5. When the printing papers different from each other in waiting position are transferred in the same manner, the amount of the sagging described above cannot be uniform and the paper supply timing to the image forming section 20 differs from paper to paper, whereby the position of the image formed on the paper is shifted.

Accordingly, in the ink jet printer 1 of this embodiment, the first paper feed mechanism 12 is controlled so that the amount of the sagging described above can be uniform.

Further, the second paper feed mechanism 14 is controlled so that the intervals between papers to be fed to the image forming section 20 are as narrow as possible and the productivity can be increased.

A method of controlling the first and second paper feed mechanisms 12 and 14 in the ink jet printer 1 of this embodiment will be described, hereinbelow.

Figure 6:
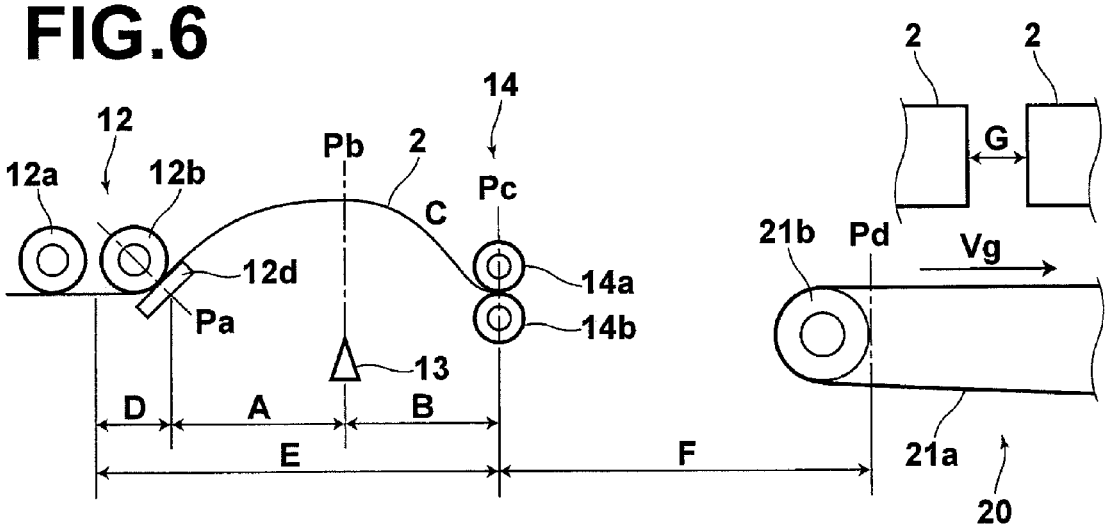
FIG. 6 is a view showing in detail the relative positions of a first paper feed mechanism, a paper edge detector, a second paper feed mechanism, and an image forming section which have been set in the ink jet printer shown in FIG. 1.

A method of controlling the first and second paper feed mechanisms 12 and 14 will be briefly described, first. FIG. 6 is a view showing in detail the relative positions of a first paper feed mechanism 12, a paper edge detector 13, a second paper feed mechanism 14, and an image forming section 20 which have been set in the ink jet printer 1. A to G and Vg in FIG. 6 have been set as follows.

Figure 7:
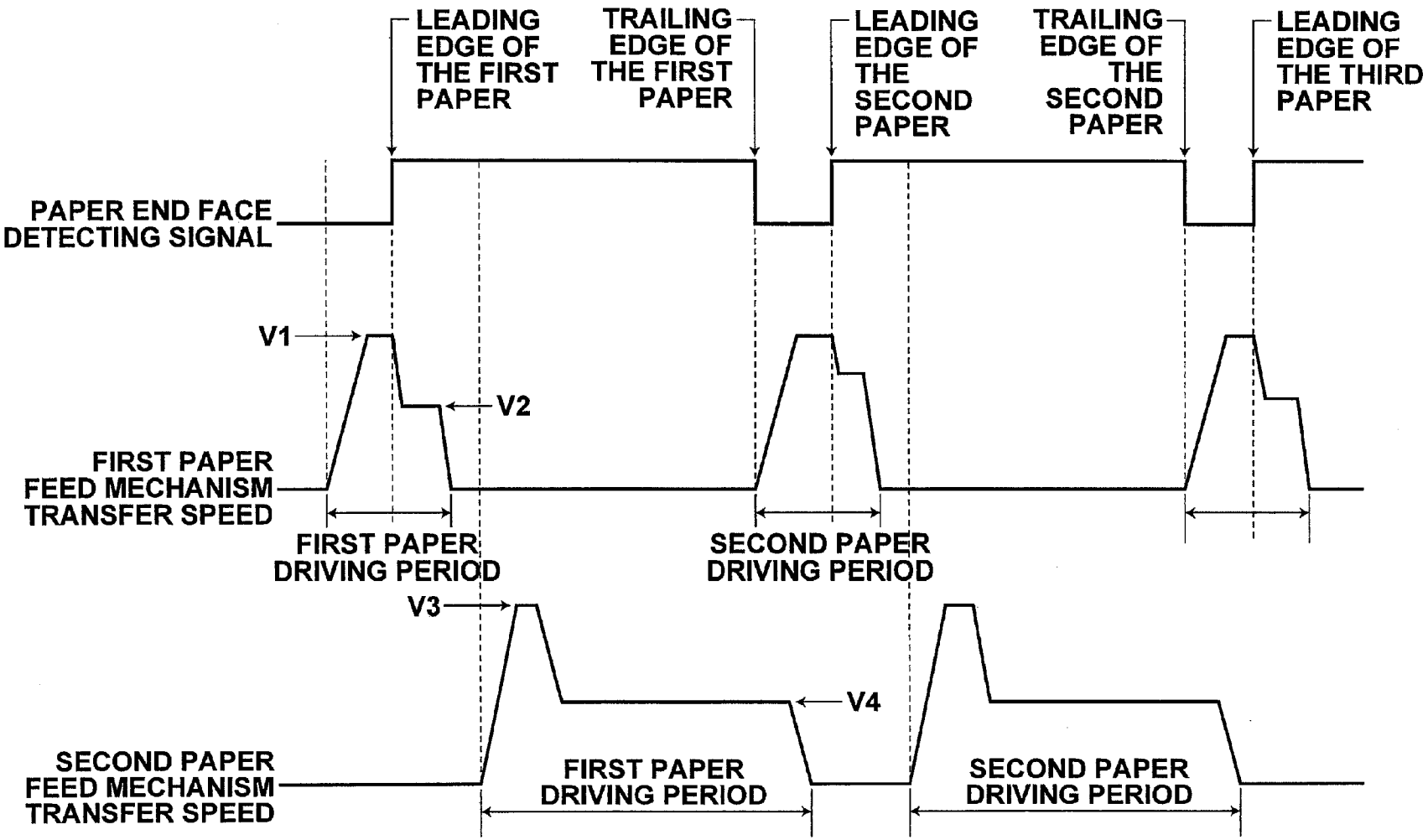
FIG. 7 is a timing chart showing the detecting signal generated by the paper edge detector, the change in the transfer speed of the first paper feed mechanism and the change in the transfer speed of the second paper feed mechanism in the ink jet printer shown in FIG. 1.
Figure 8:
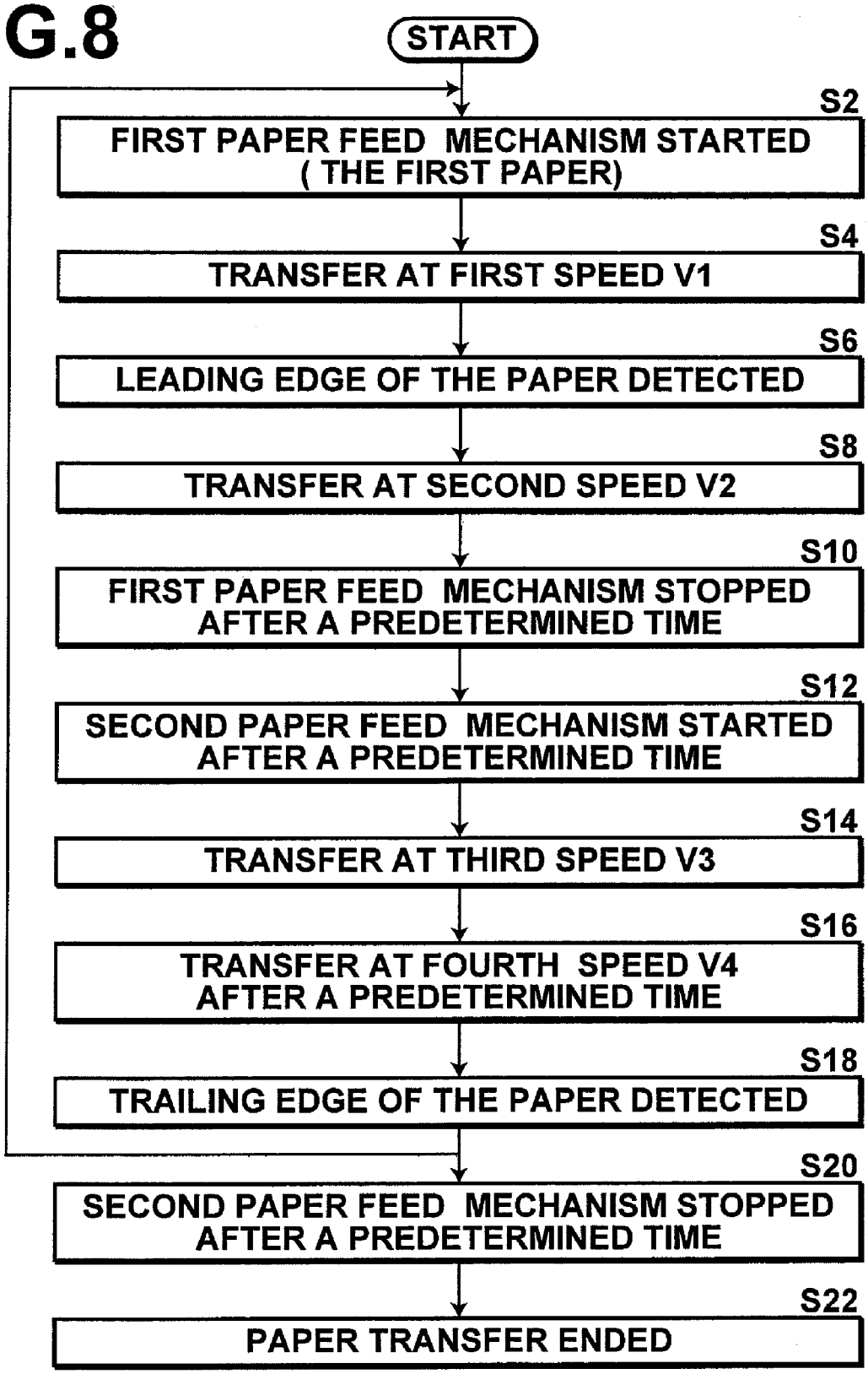
FIG. 8 is a flow chart showing in brief the controlling method of the first paper feed mechanism and the second paper feed mechanism in the ink jet printer shown in FIG. 1.

A: the distance from position Pa of the rubber roller 12*b* (at which the rubber roller 12*b* is in contact under a pressure with the separation plate 12*d*) to position Pb of the paper edge detector 13=48.7 mm B: the distance from position Pb of the paper edge detector 13 to the nipping position Pc of the transfer rollers 14*a* and 14*b*=35.3 mm C: the amount of sagging between the first and second paper feed mechanisms 12 and 14 (the amount of correction of the oblique running)=5 mm D: the margin for the waiting position of the papers (the uppermost position where the papers can be supplied)=16 mm E: the transfer distance of the first paper feed mechanism 12 (A+B+C+D)=105 mm F: the distance from the nipping position Pc of the transfer rollers 14*a* and 14*b* to the delivery position Pd to the image forming section 20=58 mm G: the paper interval (the distance between the trailing edge of the preceding paper and the leading edge of the next paper) in the image forming section 20=40 mm Vg: the paper transfer speed by the transfer belt 21*a* in the image forming section 20=700 mm/s FIG. 7 is a timing chart showing the detecting signal generated by the paper edge detector 13, the change in the transfer speed of the first paper feed mechanism 12 and the change in the transfer speed of the second paper feed mechanism 14. FIG. 8 is a flow chart showing in brief a method of controlling the first paper feed mechanism 12 and the second paper feed mechanism 14. A method of controlling the first paper feed mechanism 12 and the second paper feed mechanism 14 will be described in brief with reference to FIGS. 7 and 8, hereinbelow.

A print instruction is first input through the operator input section 40 and the paper feed table 11 is lifted to a position where the uppermost paper is in contact with the first paper feed mechanism 12 under a pressure. The other part of the control necessary to transfer in the image forming section 20 is prepared while the transfer speed by the transfer belt 21*a* of the paper transfer means 21 in the image forming section 20 is held at the default (700 mm/s)

Then the paper feed control section 15 starts the first paper feed drive motor 12*c* of the first paper feed mechanism 12 with a predetermined acceleration (S2). Then the first paper feed mechanism 12 starts to transfer the uppermost paper in the stack on the paper feed table 11. After the transfer speed of the first paper feed mechanism 12 reaches the first speed V1 which has been set in advance, the first paper feed mechanism 12 continues to transfer the paper holding the speed (S4).

When the leading edge of the paper reaches the paper edge detector 13, the leading edge is detected by the paper edge detector 13. (S6) The paper feed control section 15 decelerates the first paper feed drive motor 12*c* of the first paper feed mechanism 12 with a predetermined acceleration according to the detecting signal (the rising up in FIG. 7) to change the transfer speed of the first paper feed mechanism 12 to the second speed V2 (S8). After transferring at the second speed V2 for a predetermined time, the paper feed control section 15 decelerates the first paper feed drive motor 12*c* of the first paper feed mechanism 12 with a predetermined acceleration to stop the first paper feed mechanism 12 (S10). The second speed V2 is lower than the first speed V1.

When a predetermined time lapses after the first paper feed mechanism 12 is stopped, the second paper feed mechanism 14 is started (S12). After the second paper feed drive motor 14*c* of the second paper feed mechanism 14 is accelerated with a predetermined acceleration for the transfer speed of the second paper feed mechanism 14 to reach the third speed V3, the speed is held (S14). Then after transferred at the third speed V3 for a predetermined time by the second paper feed mechanism 14, the second paper feed drive motor 14*c* of the second paper feed mechanism 14 is decelerated with a predetermined acceleration, and once reaching the fourth speed V4, the second paper feed mechanism 14 continues to transfer the paper holding the speed (S16). The fourth speed V4 is lower than the third speed V3 and equal to the transfer speed of the paper transfer means 21 in the image forming section 20.

Though, in the image forming section 20, the paper transfer means 21 transfers the paper 2 attracting the same under a suction force or an electrostatic force, as described above, a sufficient transfer force cannot be expected in this system when the paper 2 is not fed sufficiently home into the paper transfer means 21. That is, the accuracy in the image forming depends on the paper transfer speed of the second paper feed mechanism 14. Accordingly, when the leading edge of the paper 2 reaches a position immediately before the image forming section 20 (position Pd shown in FIG. 6), it is necessary for the transfer speed of the second paper feed mechanism 14 to be at the fourth speed V4 equal to the transfer speed of the paper transfer means 21 in the image forming section 20.

When the trailing edge of the paper 2 reaches the paper edge detector 13 and is detected thereby (S18), the processing of step S2 and the following steps is repeated again in response to the detecting signal of the paper edge detector 13 (downward movement in FIG. 7), and the first paper feed mechanism 12 starts feeding a second paper.

On the other hand, the second paper feed mechanism 14 transfers the paper 2 for a predetermined time after the trailing edge of the first paper is detected by the paper edge detector 13 and is stopped (S20) to terminate the transfer of the first paper (S22) when the trailing edge of the first paper is passed by the transfer rollers 14*a* and 14*b* of the second paper feed mechanism 14.

The second paper and the following papers are transferred in the same manner as the first paper.

Figure 9:
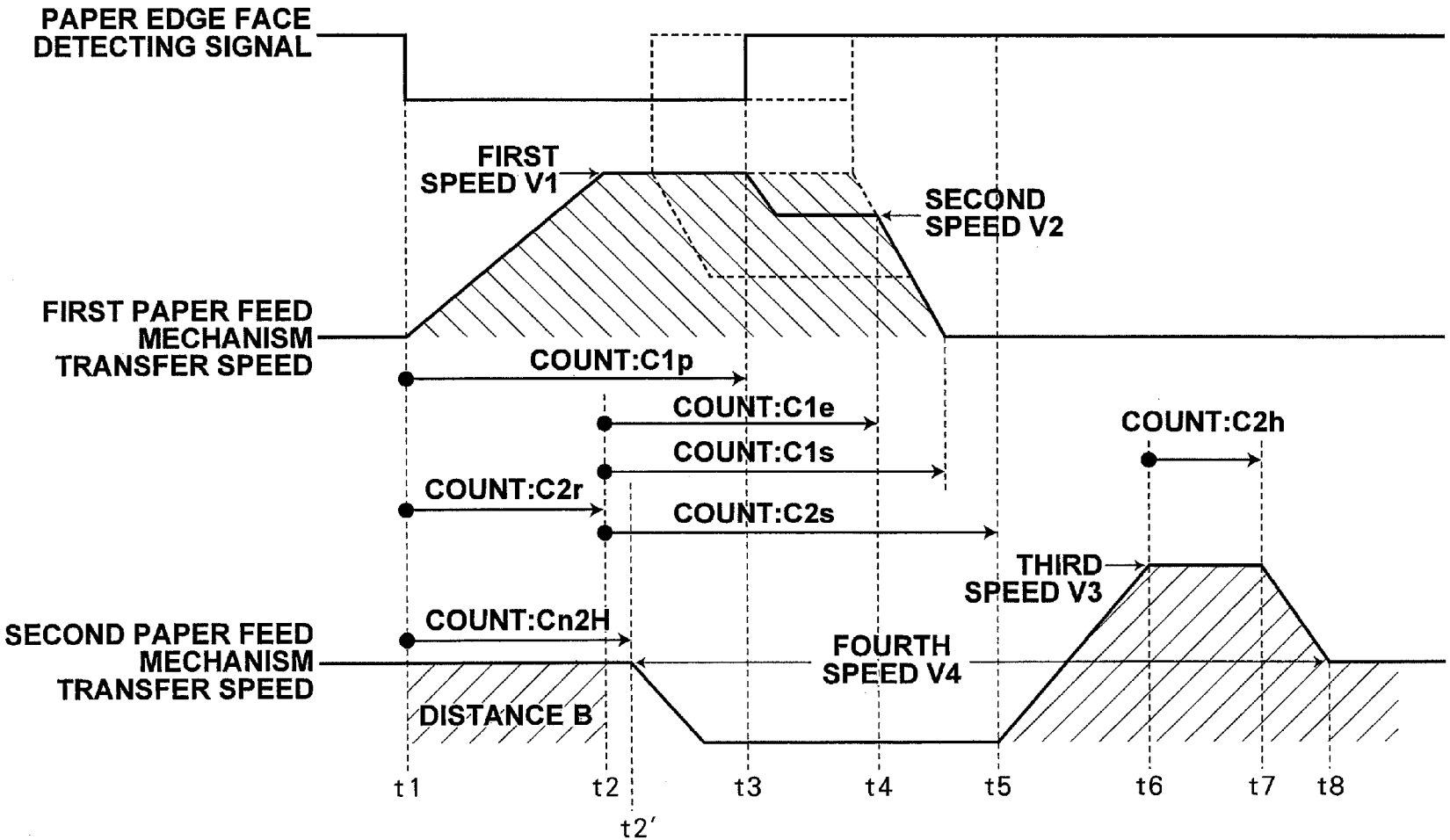
FIG. 9 is a timing chart showing the detecting signal generated by the paper edge detector, the change in the transfer speed of the first paper feed mechanism, the change in the transfer speed of the second paper feed mechanism and the count of the print pulse signals in the ink jet printer in accordance with the first embodiment, FIGS. 10A and 10B make up FIG. 10 showing in detail a method of controlling the first paper feed mechanism in the ink jet printer in accordance with the first embodiment.
Figure 10A:
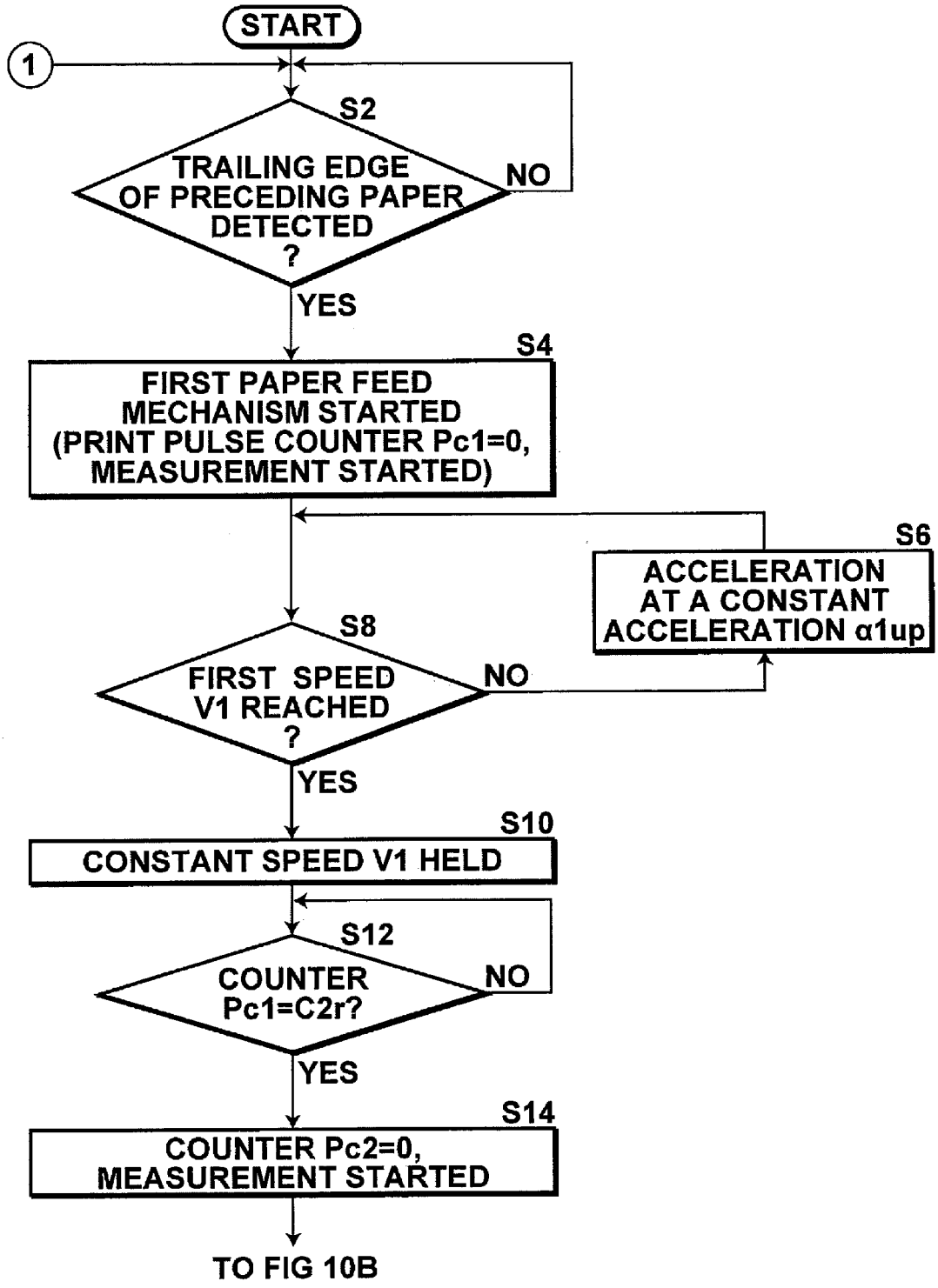
Figure 10B:
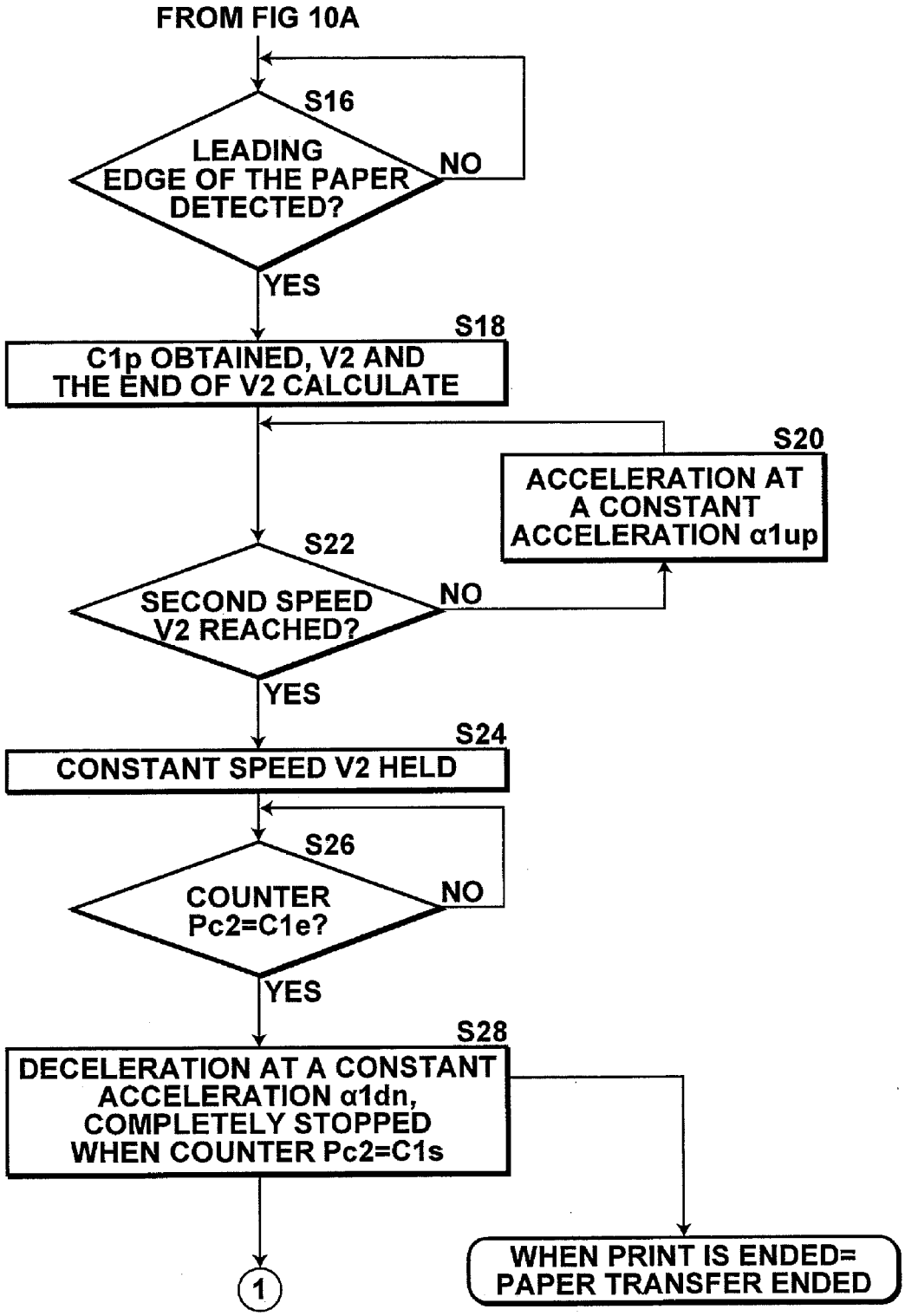

A method of controlling the first paper feed mechanism 12 will be described in more detail, hereinbelow. FIG. 9 is a timing chart showing the detecting signal generated by the paper edge detector 13, the change in the transfer speed of the first paper feed mechanism 12, the change in the transfer speed of the second paper feed mechanism 14 and the count of the print pulse signals. FIGS. 10A and 10B make up FIG. 10 showing in detail a method of controlling the first paper feed mechanism 12.

Whether the trailing edge of the preceding paper is detected is monitored through the paper edge detector 13(S2). When the trailing edge of the preceding paper is detected by the paper edge detector 13 (time t1 in FIG. 9, downward movement of the detecting signal of the paper edge detector 13), the paper feed control section 15 drives the first paper feed drive motor 12*c* of the first paper feed mechanism 12 to start transfer of the paper and at the same time resets to 0 the counter Pc1 of the print pulse output from the paper transfer control section 23, thereby starting measurement of the counter Pc1 (S4). It is assumed that the paper transfer means 21 has been started at this time and the paper transfer control section 23 outputs the print pulse generated by the rotary encoder 21*c* for the image forming section. In the case of a paper where there is no paper transferred previously, S4 is carried out at any timing.

The paper feed control section 15 accelerates the first paper feed drive motor 12*c* of the first paper feed mechanism 12 at a predetermined acceleration $\alpha 1up$ (S6, S8) so that the transfer speed of the first paper feed mechanism 12 reaches the preset first speed V1. Then when the transfer speed of the first paper feed mechanism 12 reaches the first speed V1, the paper feed control section 15 holds the speed (S10).

The counter Pc1 is monitored (S12) and measurement of the counter Pc2 is started after the counter Pc2 is reset to 0 when the counter Pc1 becomes a preset C2*r* (time t2 in FIG. 9) (S14). The value of the C2*r* will be described in detail later. When the counter Pd1 becomes a preset C2*r* is a time when the trailing edge of the preceding paper is passed by the transfer rollers 14*a* and 14*b* of the second paper feed mechanism 14. Then whether the leading edge of the next paper is detected is monitored through the paper edge detector 13 (S16). When the leading edge of the paper is detected by the paper edge detector 13 (time t31 in FIG. 9), the paper feed control section 15 obtains the value of the counter Pc1 as a C1P, calculates the second speed V2 on the basis of the C1P and calculates the end C1*e* of the second speed V2 by the use of the calculated second speed V2 (S18). The timing at which the leading edge of the paper is detected depends on the waiting position and the transfer ratio of the paper by the first paper feed mechanism 12, "the transfer ratio" being a value obtained by dividing a speed of the paper itself transferred by the first paper feed mechanism 12 by the transfer speed of the first paper feed mechanism controlled by a first paper feed mechanism speed control section 16. (See the dotted line part of the paper edge detector 13 in FIG. 9.) The second speed V2 differs depending on the timing at which the leading edge of the paper is detected. (See the dotted line part of the transfer speed of the first paper feed mechanism 12 in FIG. 9.) The method of calculating the second speed V2 and C1*e* will be described later in detail. Further, the paper feed control section 15 determines that there is generated a paper transfer-error when the count of the pulses of the C1*p* thus obtained is not smaller than a predetermined value (e.g., 630 in this embodiment) and outputs a control signal to make an alarm sound or an alarm display representing that there is generated a paper transfer-error.

Further, the paper feed control section 15 decelerates the first paper feed drive motor 12*c* at a predetermined acceleration $\alpha 1dn$ (S20, S22) so that the transfer speed of the first paper feed mechanism 12 reaches the second speed V2. Then when the transfer speed of the first paper feed mechanism 12 reaches the first speed V1, the paper feed control section 15 holds the speed V 2 (S24).

The counter Pc2 is monitored (S26) and when the counter Pc2 becomes the end C1*e* of the second speed V2 (time t4 in FIG. 9), the paper feed control section 15 decelerates the first paper feed drive motor 12*c* at a predetermined acceleration α1*d* and stops the first paper feed drive motor 12*c*, when the counter Pc2 becomes the C1*s*(S28).

When there is a next paper, the first paper feed mechanism 12 executes the processing of step S2 and the following steps, while when there is no next paper, the first paper feed mechanism 12 terminates transfer of the papers.

Though, in the above description, the measurement of the counter Pc2 is started in S14 and the counter Pc2 is monitored whether it becomes the end C1*e* in S26 and whether it becomes the C1*s* in S28, it is not necessary to use the counter Pc2 but the counter Pc1 may be used to monitor whether the counter Pc1 becomes C2*r*+C1*e* in S26 and whether the counter Pc1 becomes C2*r*+C1*s* in S28.

The counts and the first and second speeds V1 and V2 used in the description of controlling the first paper feed mechanism 12 made above will be described, hereinbelow.

The C2*r* is the distance B of movement of the trailing edge of the paper 2 from the time when the leading edge of the preceding paper 2 is detected by the paper edge detector 13 to the time when the trailing edge thereof reaches the second paper feed mechanism 14 in terms of counts of the print pulse signals. Accordingly, it is a constant value irrespective of the paper transfer speed Vg of the image forming section 20. The ink jet printer 1 of this embodiment is 300 [dpi]=25.4 [mm]/300=84.667 [μm] in pixel density Gp. Accordingly, C2*r*=B/Gp=35.3 [mm]/=84.667 [μm]=417.

Figure 11:
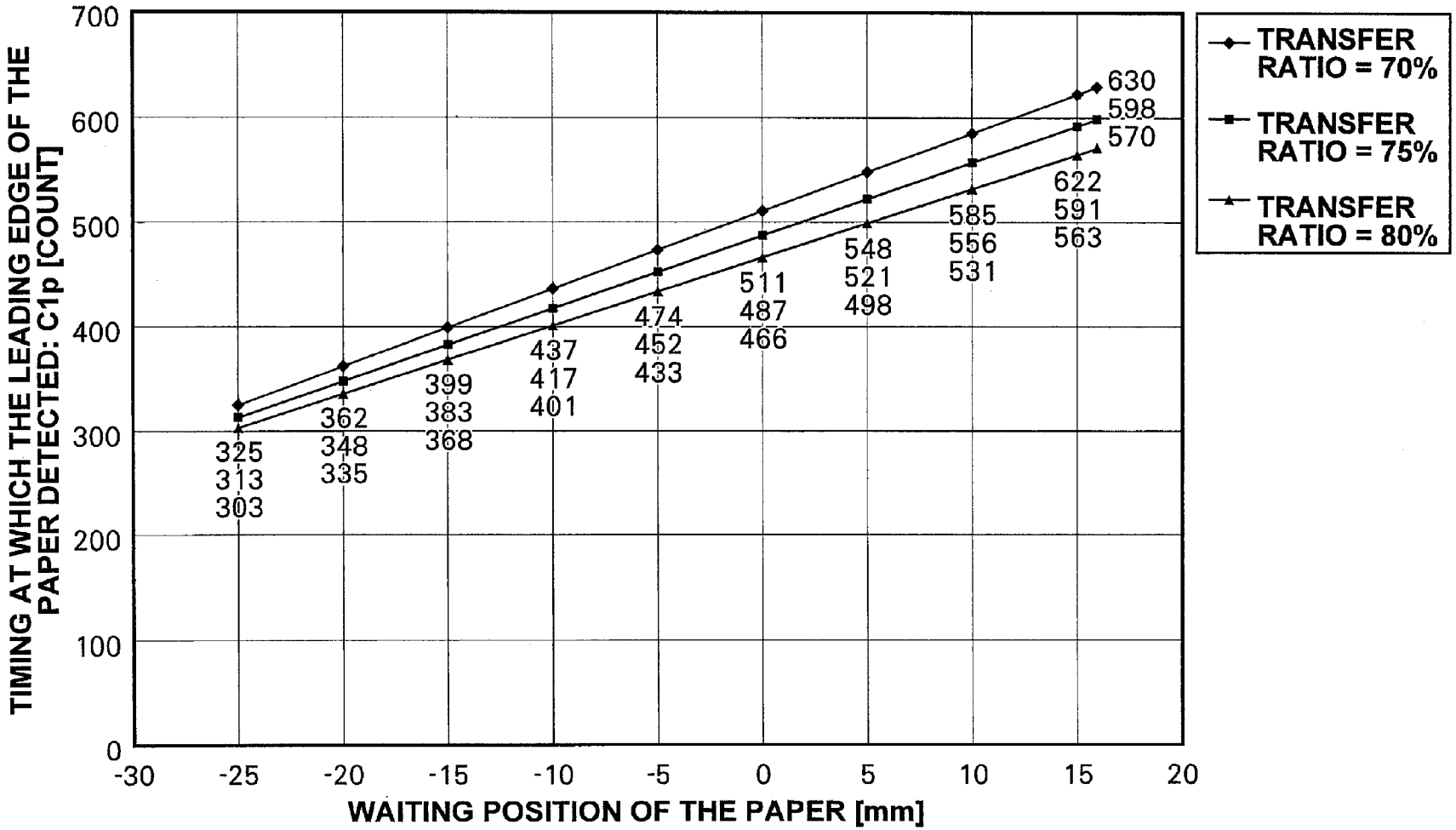
FIG. 11 is a graph showing a relation of C1*p* and a waiting position of the papers when the paper transfer speed Vg in the image forming section is 700 [mm/s]
Figure 12:
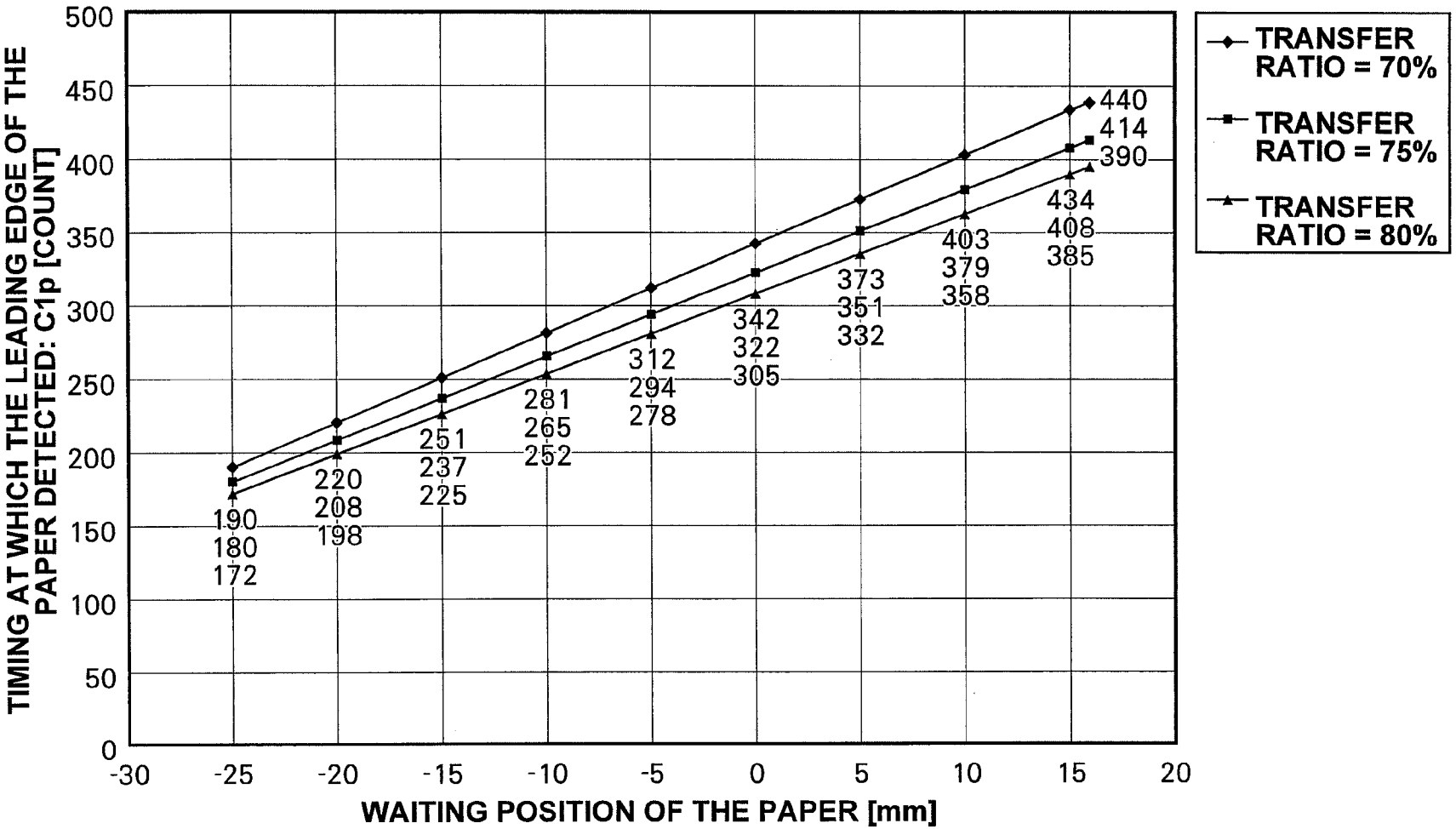
FIG. 12 is a graph showing a relation of C1*p* and a waiting position of the papers when the paper transfer speed Vg in the image forming section is 350 [mm/s]

C1*p* is a count from the time at which the paper transfer by the first paper feed mechanism 12 is started to a time at which the leading edge of the paper is detected and a value thereof depends on the waiting position and the transfer ratio of the papers. FIG. 11 is a graph showing a relation of C1*p* and a waiting position of the papers when the paper transfer speed Vg in the image forming section is 700 [mm/s] in the ink jet printer of this embodiment. The waiting position of the papers are represented by 0 in the case of the waiting position shown by Pa in FIG. 6 with those on the upstream side thereof represented by positive values and those on the downstream side thereof represented by negative values. As shown in FIG. 11, the value of the C1*p* is increased as the waiting position is on a more upstream side and as the paper transfer speed Vg is reduced. FIG. 12 is a graph showing a relation of C1*p* and a waiting position of the papers when the paper transfer speed Vg in the image forming section 20 is 350 [mm/s] in the ink jet printer of this embodiment.

The C1*s* corresponds to a time from the time immediately after the trailing edge of the paper is passed by the transfer rollers 14*a* and 14*b* of the second paper feed mechanism 14 to the time at which the paper transfer by the first paper feed mechanism 12 is stopped which is obtained by multiplying a time t=770 [ms] by the count and is in terms of the count. Since the time t can be represented as t=count×Gp/Vg, the formula according to which the time t is converted to the count is count=Vg×t/Gp. Accordingly, C1*s*=70 [ms]/84.667 [μm]×Vg=0.827×Vg.

Figure 13:
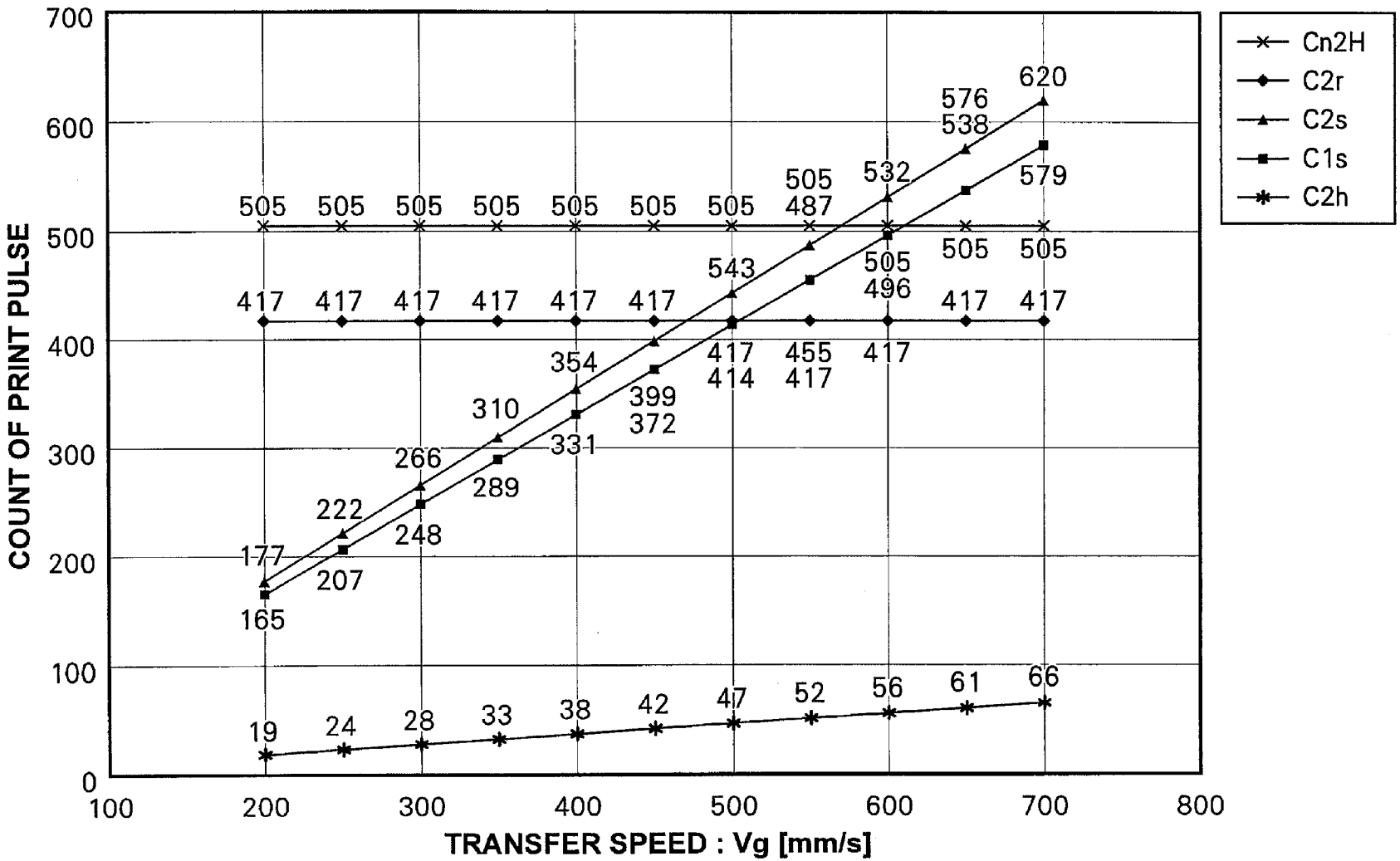
FIG. 13 is a graph showing a change of the value of Cn2H, C2*r*, C2*s*, C1*s*, or C2*h* when the paper transfer speed Vg in the image forming section is changed.

Further, though the transfer speed Vg by the second paper feed mechanism 14 in the image forming section is set at 700 [mm/s] in the ink jet printer of this embodiment, FIG. 13 is a graph showing a change of the value of C2*r* or C1*s*, when the paper transfer speed Vg is changed. The C2*r* is a constant value 417 irrespective of the Vg as described above. The C1*s* is in proportion to the Vg.

The method of calculating the first speed V1 will be described, hereinbelow. The first speed V1 is determined to deliver the papers to the second paper feed mechanism 14 under the conditions where the waiting position of the papers on the paper feed table 11 are in the most upstream side and the transfer ratio by the first paper feed mechanism 12 is minimum. By this, the conditions where the first speed V1 is not lower than the second speed V2 are set. Of course, the second speed V2 is equal to the first speed V1 at most.

Figure 14:
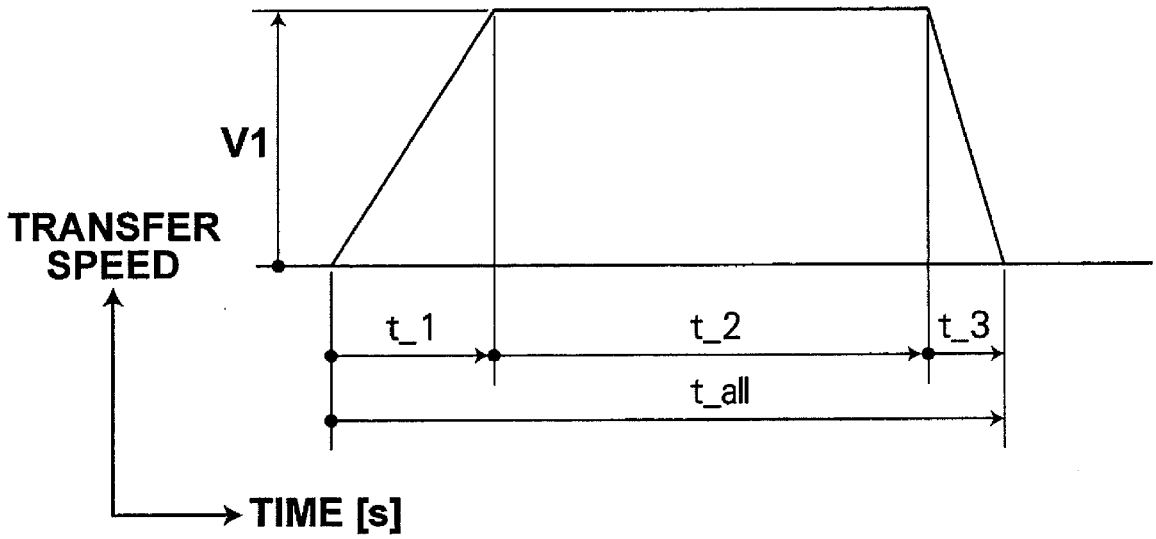
FIG. 14 is a view showing a method of calculating a first speed V1.

The transfer distance E of the paper itself by the first paper feed mechanism 12 is A+B+C+D. Assuming that the minimum transfer ratio is 70%, the transfer distance E of the first paper feed mechanism 12 is E/0.7. Accordingly, the area of the trapezoid shown in FIG. 14 should be E/0.7.

From FIG. 9, $$t_all=(C2r+C1s)\times Gp/Vg[s]$$

$$t_1=V1/\alpha 1up\ [s]$$

$$t_3=V1/\alpha 1dn\ [s]$$

The α1*up* and α1*dn* are fixed values governed by system and irrespective of the Vg. Accordingly, $$t_2=t_all-(t_1+t_3)\ [s]=(C2r+C1s)\times Gp/Vg-(V1/\alpha 1up+V1/\alpha 1dn)$$

Since, $$V1\times t_1/2+V2\times t_2+V1\times t_3/2=E/0.7,$$

substitution of t_1, t_2 and t_3 in the above formula gives the following.

$$a\cdot V1^2-bV1+c=0 \text{ wherein}$$

$$\{1/(2\times\alpha 1up+1/(2\times\alpha 1dn)\}=a,\ \{(C2r+C1s)\times Gp/Vg\}=b,\ \{E/0.7\}=c$$

Accordingly, $$V1=\{b-\sqrt{(b^2-4a\cdot c)}\}/(2\cdot a)$$

Figure 15:
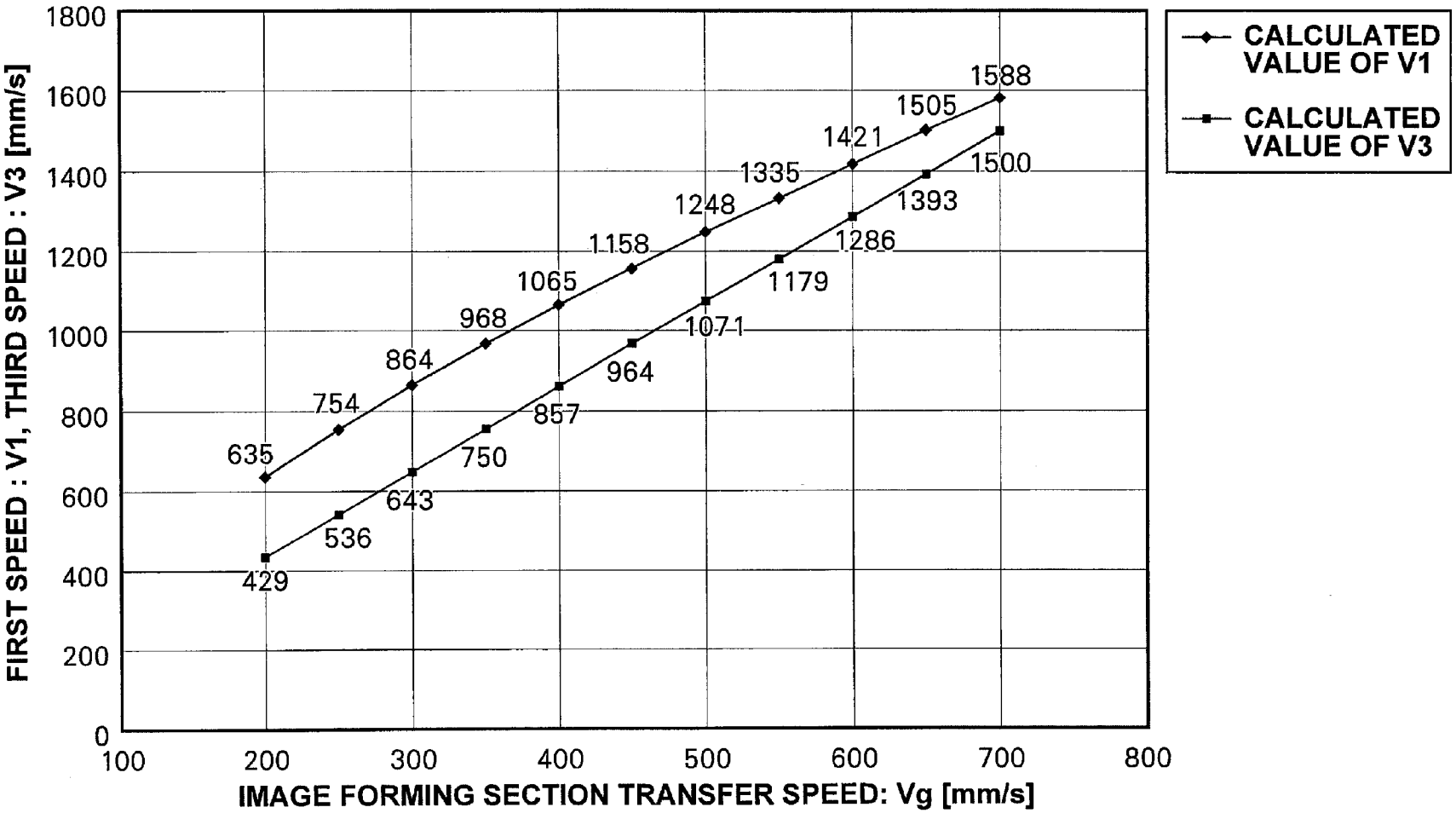
FIG. 15 is a graph showing changes of the first and third speeds V1 and V3 when the paper transfer speed Vg in the image forming section is changed.

The first speed V1 can be calculated in the manner described above. FIG. 15 is a graph showing change of the first speed V1 when the paper transfer speed Vg in the image forming section 20 is changed in the ink jet printer of this embodiment. As shown in FIG. 15, the first speed V1 is in proportion to the paper transfer speed Vg in the image forming section 20.

Figure 16:
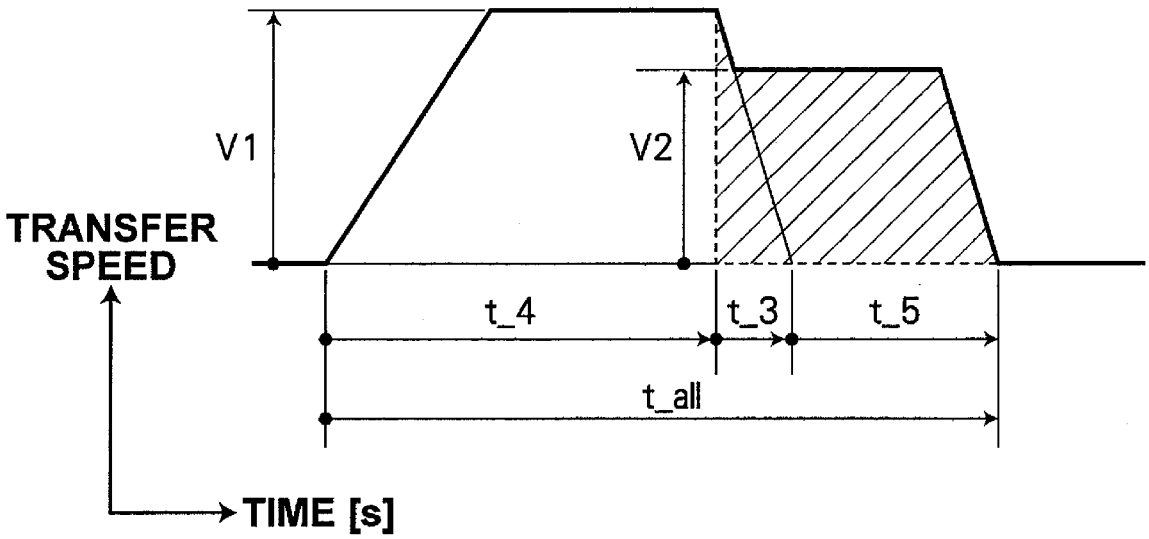
FIG. 16 is a view showing a method of calculating a second speed V2.

A method of calculating the second speed V2 will be described, hereinbelow. In order to calculate the second speed V2, that the area of the hatched portion in FIG. 16 should be equal to the transfer distance of the paper by the first paper feed mechanism 12 from when the leading edge of the paper is detected to when the first paper feed mechanism 12 is stopped is used. The transfer distance of the paper itself from when the leading edge of the paper is detected to when the first paper feed mechanism 12 is stopped is B+C. Accordingly, when it is assumed that the central transfer distance of the paper by the first paper feed mechanism 12 is 0.75, the transfer distance of the paper by the first paper feed mechanism 12 from when the leading edge of the paper is detected to when the first paper feed mechanism 12 is stopped (B+C)/0.75.

From FIG. 9, $$t_all=(C2r+C1s)\times Gp/Vp\ [s]$$

$$t_3=V1/\alpha 1dn\ [s]$$

$$t_4=C1p\times Gp/Vg\ [s]$$

$$t_5=t_all-(t_3+t_4)\ [s]=(C2r+C1s-C1p)\times Gp/Vg-V1/\alpha 1dn$$

Accordingly, $$(B+C)/0.75=t_3\times V1/2+t_5\times V2$$

Accordingly, $$\begin{aligned} V2 &= \{(B+C)/0.75 - t_3\times V1/2\}/t_5 \\ &= \{(B+C)/0.75 - V1^2/2\cdot\alpha 1dn\}/t_5 \\ &= \left\{\begin{matrix}(B+C)/0.75 - \\ V1^2/2\cdot\alpha 1dn\end{matrix}\right\} \Big/ \left\{\begin{matrix}(C2r + C1s - C1p)\times \\ Gp/Vg - V1/\alpha 1dn\end{matrix}\right\} \end{aligned}$$

The second speed V2 can be calculated according to the above formula so long as the waiting positions of papers are not larger than D and not smaller than −25 mm under the conditions of A to Vg described above with the structure shown in FIG. 6 (the waiting position of the papers are represented by 0 in the case of the waiting position shown by Pa in FIG. 6 with those on the upstream side thereof represented by positive values and those on the downstream side thereof represented by negative values).

Figure 17:
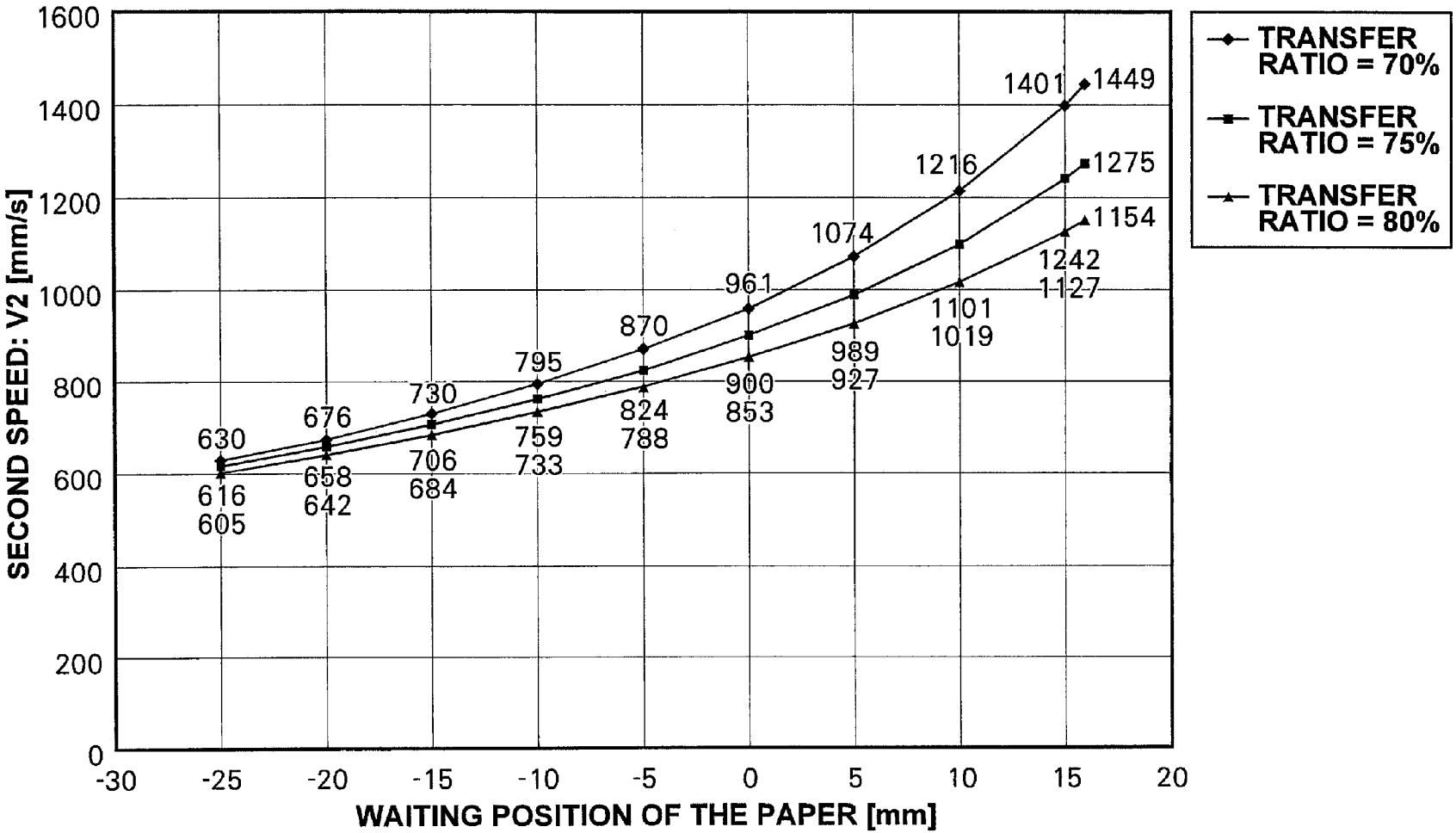
FIG. 17 is a graph showing a relation of the second speed V2 and the waiting position of the papers when the paper transfer speed Vg in the image forming section is 700 [mm/s]
Figure 18:
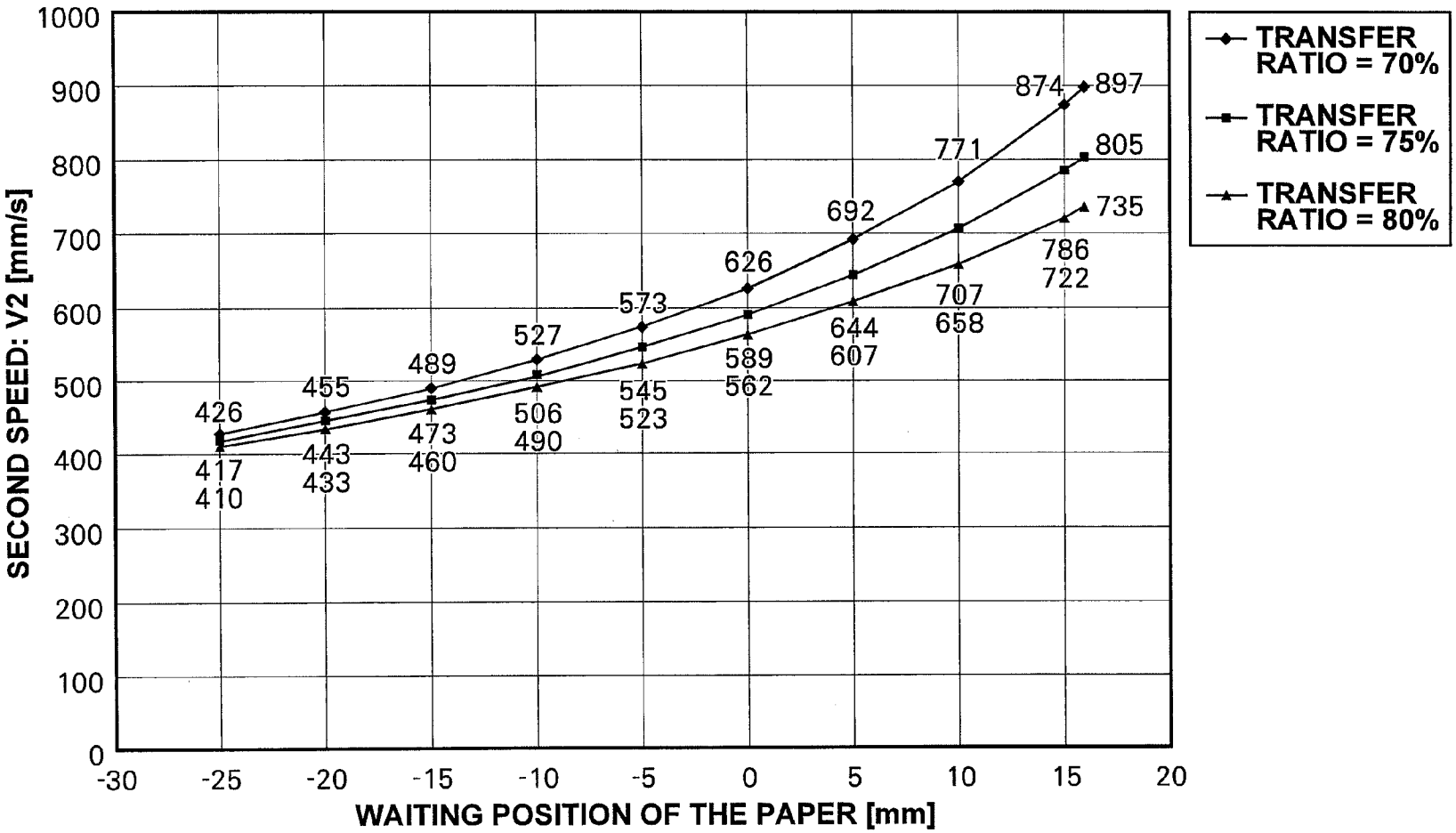
FIG. 18 is a graph showing a relation of the second speed V2 and the waiting position of the papers when the paper transfer speed Vg in the image forming section is 350 [mm/s]

The second speed V2 can be obtained in the manner described above and though the second speed V2 can be changed depending on the waiting position of the paper, FIG. 17 is a graph showing a relation of the second speed V2 and the waiting position of the papers. In FIG. 17, the relation is calculated assuming that the paper transfer speed Vg is 700 [mm/s]. In FIG. 17, the waiting position of the papers are represented by 0 in the case of the waiting position shown by Pa in FIG. 6 with those on the upstream side thereof represented by positive values and those on the downstream side thereof represented by negative values. Further, though in the embodiment described above, the second speed V2 is calculated on the basis of the assumption that the paper transfer ratio of the first paper feed mechanism 12 is 75%, also results where the second speed V2 are calculated on the basis of the assumption that the paper transfer ratios of the first paper feed mechanism 12 are 70% and 80% are shown. As shown in FIG. 17, the second speed V2 is increased as the waiting position is on a more upstream side and as the paper transfer speed Vg of the first paper feed mechanism 12 is reduced. FIG. 18 is a graph showing the second speed V2 calculated on the assumption that the paper transfer speed Vg in the image forming section is 350 [mm/s].

A method of calculating the end C1*e* at the second speed V2 will be described, hereinbelow.

Figure 19:
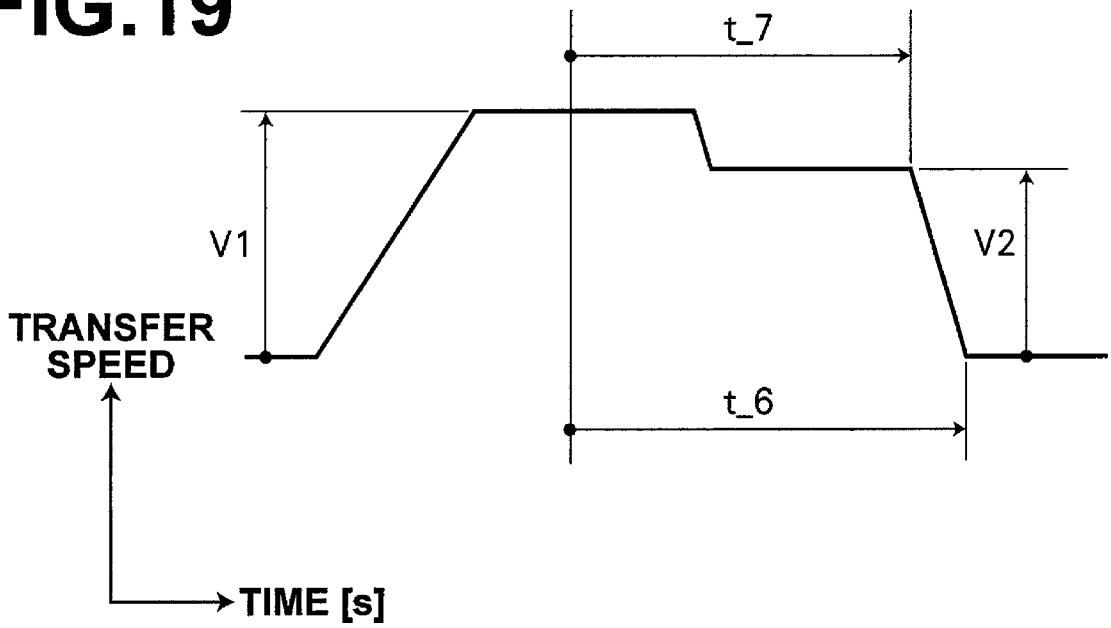
FIG. 19 is a view showing a method of calculating a value C1*e* of termination of transfer at the second speed V2.

To calculate the C1*e*, t_7 shown in FIG. 19 may be used. That is, from FIG. 19, $$t_6=C1s\times Gp/Vg\ [s]$$

Accordingly, $$\begin{aligned} t_7 &= t_6 - V2/\alpha 1dn \\ &= C1s\times Gp/Vg - V2/\alpha 1dn[s] \\ C1e &= t_7\times Vg/Gp \\ &= C1s - (V2/\alpha 1dn)\times Vg/Gp \end{aligned}$$

The times t_all and t_1 to t_7 used in the description above are used for the purpose of simplicity of description and are not actually used in the calculation in the ink jet printer of this embodiment. In the ink jet printer of this embodiment, by reflecting the time information such as those described above as a count of the print pulse, the paper transfer can be controlled only by counting the print pulse in synchronization with the image forming section 20 and the paper transfer speed Vg instructed by the operator.

Figure 20:
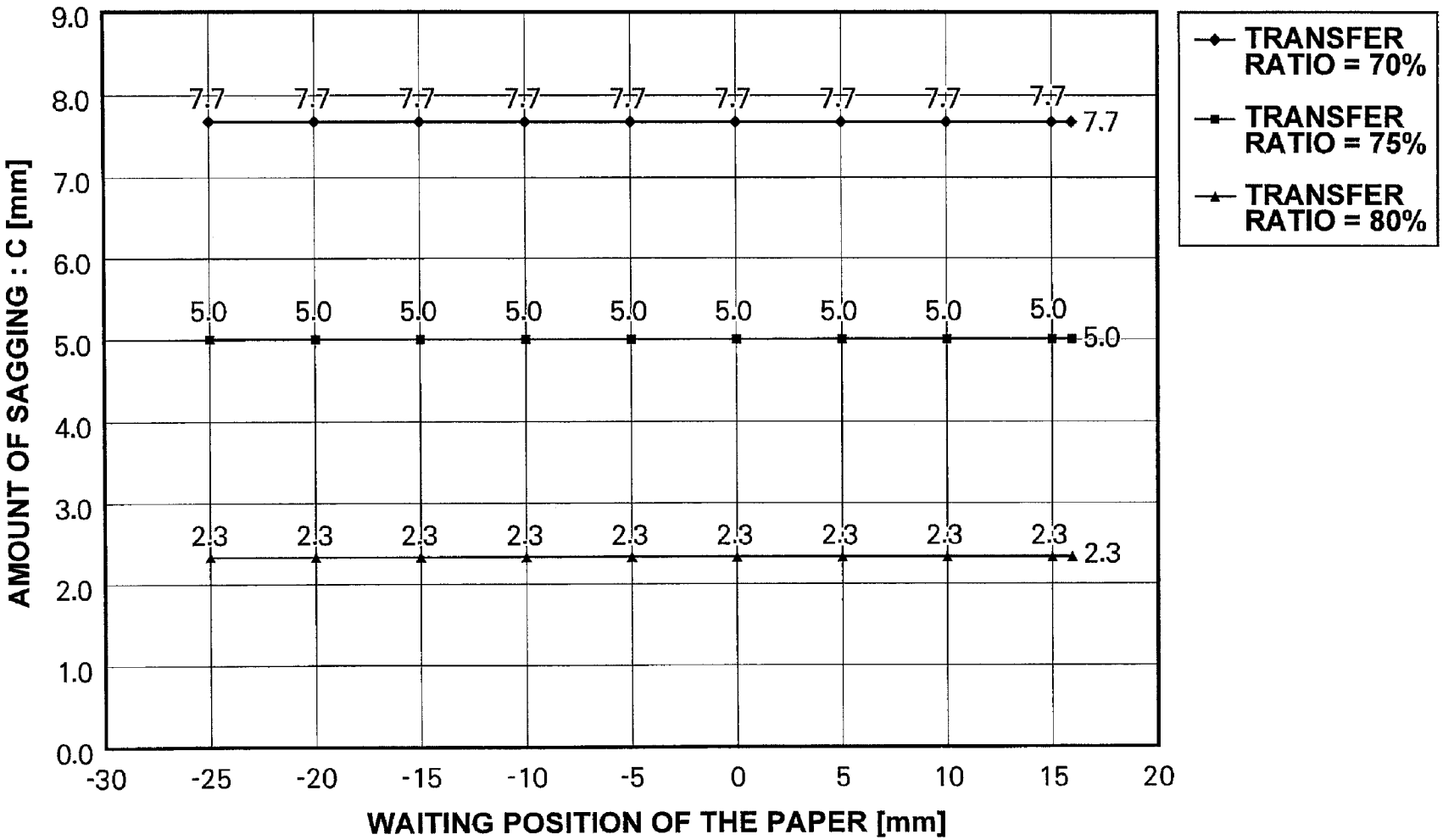
FIG. 20 is a graph showing a relation of the waiting position of the papers and the amount of sagging when the first paper feed mechanism is controlled in accordance with the first embodiment of the present invention.
Figure 21:
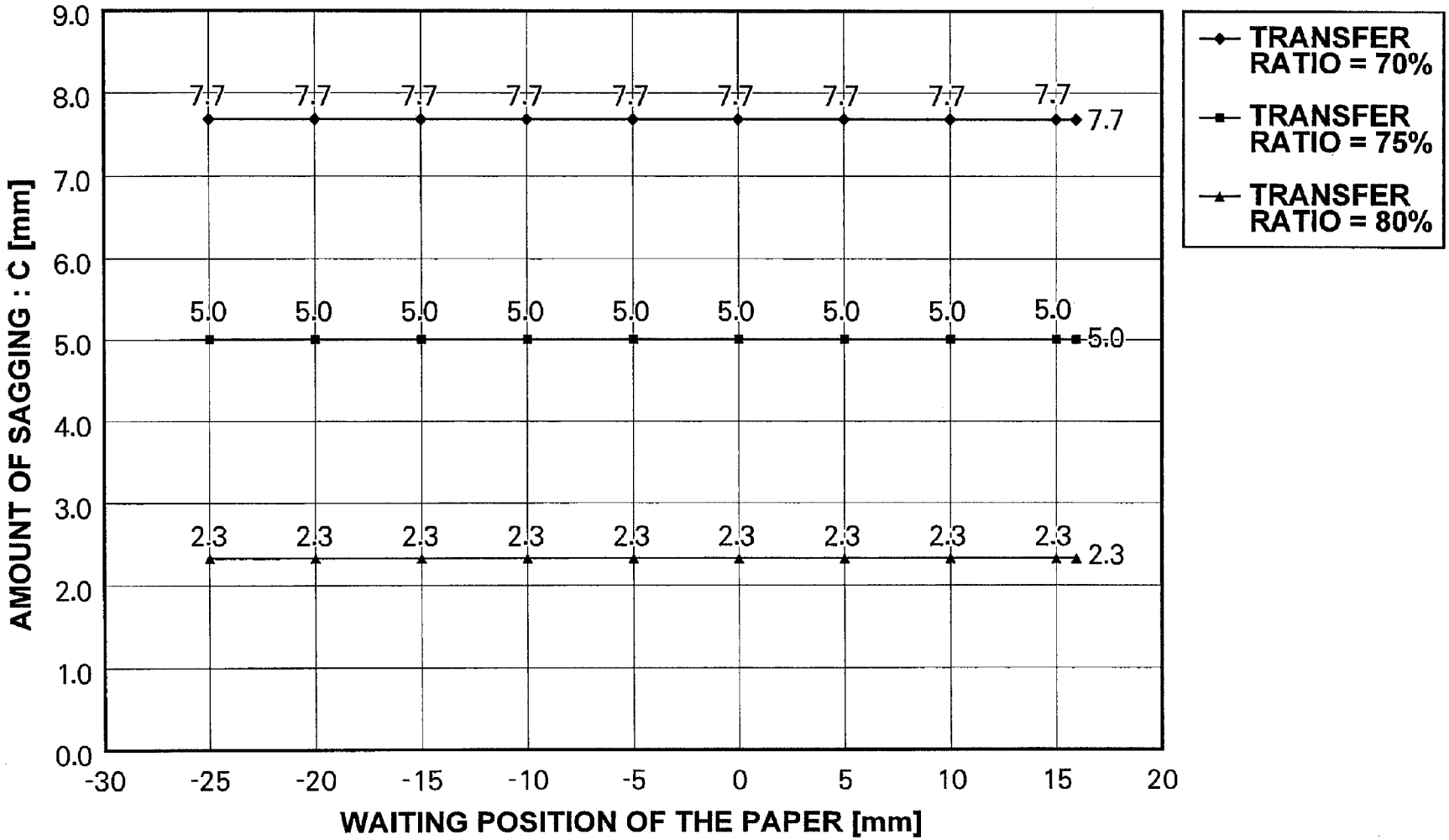
FIG. 21 is a graph showing a relation of the waiting position of the papers and the amount of sagging when the first paper feed mechanism is controlled in accordance with the first embodiment of the present invention.

In the ink jet printer of this embodiment, the second speed V2 and the count of the end C1*e* of the transfer at which the papers are transferred at the second speed V2 are determined according to the timing at which the leading edge of the paper is detected by the paper edge detector 13. Accordingly, the sagging of the papers is uniform irrespective of the waiting positions of the papers as shown in FIG. 20. In the ink jet printer of this embodiment, though since the second speed V2 and the count of the C1*e* are calculated on the assumption that the transfer ratio by the first paper feed mechanism 12 is 75%, the amount of the sagging is equal to a target designed value 5 mm, when the transfer ratio of the papers is changed, the amount of the sagging is also changed. FIG. 20 shows the amount of sagging when the second speed V2 and the count of the C1*e* are calculated on the assumption that the transfer ratio is 70% or 80%. That is, in the ink jet printer of this embodiment, the amount of the sagging can be held uniform irrespective of waiting positions of the printing papers. However, when, for instance, the transfer ratio of the printing paper is changed due to change in the quality, the amount of the sagging of the papers is changed under the influence thereof. FIG. 20 shows the amount of sagging when the transfer ratio Vg in the image forming section is 700 [mm/s] while FIG. 21 shows the amount of sagging when the transfer ratio Vg in the image forming section is 350 [mm/s]. As shown in FIGS. 20 and 21, the amount of the sagging is unchanged from the case where the transfer ratio Vg in the image forming section is 700 [mm/s] to the case where the transfer ratio Vg in the image forming section is 350 [mm/s].

Figure 22A:
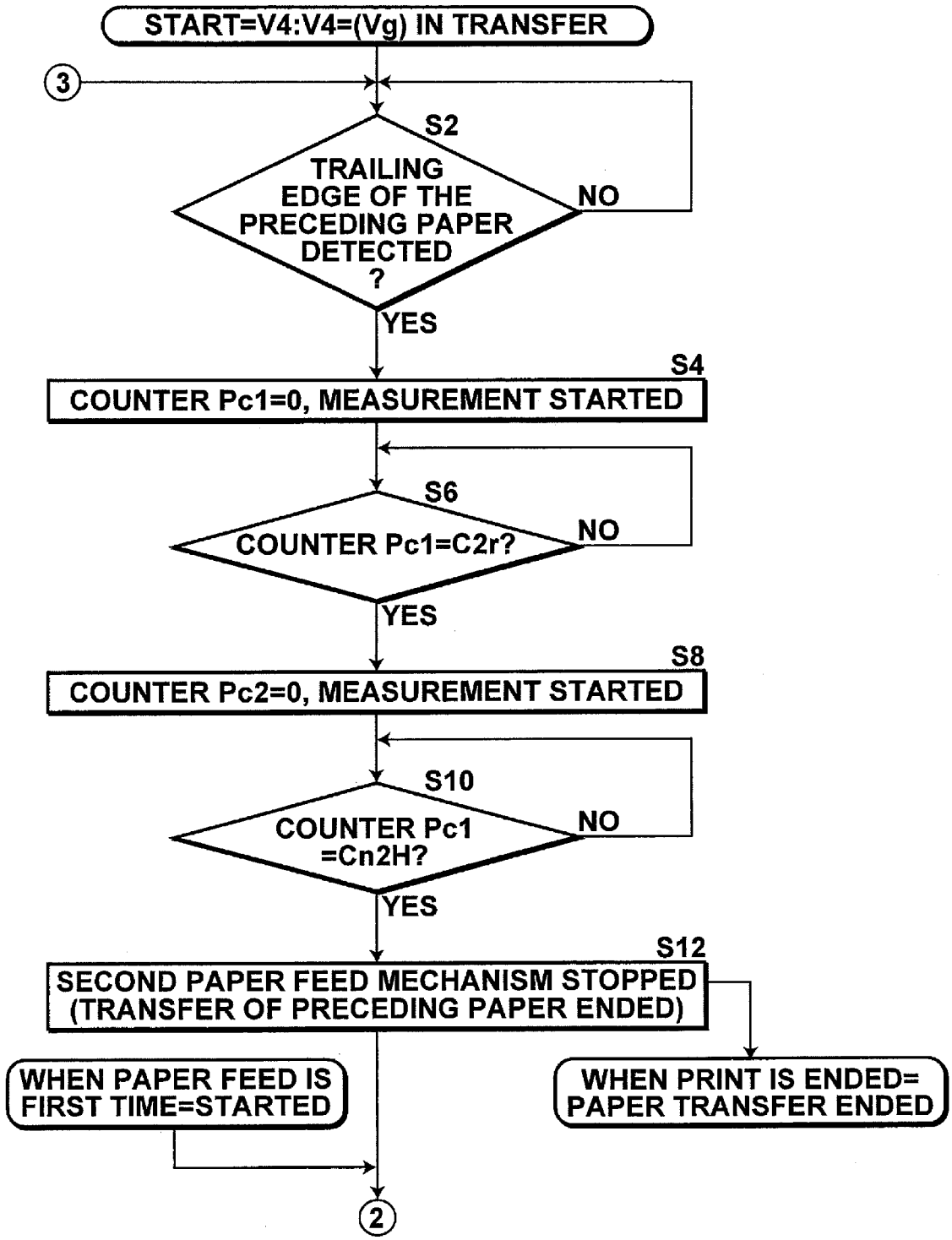
FIG. 22A is a part of a flow chart showing in detail a method of controlling the second paper feed mechanism in the ink jet printer in accordance with the first embodiment.
Figure 22B:
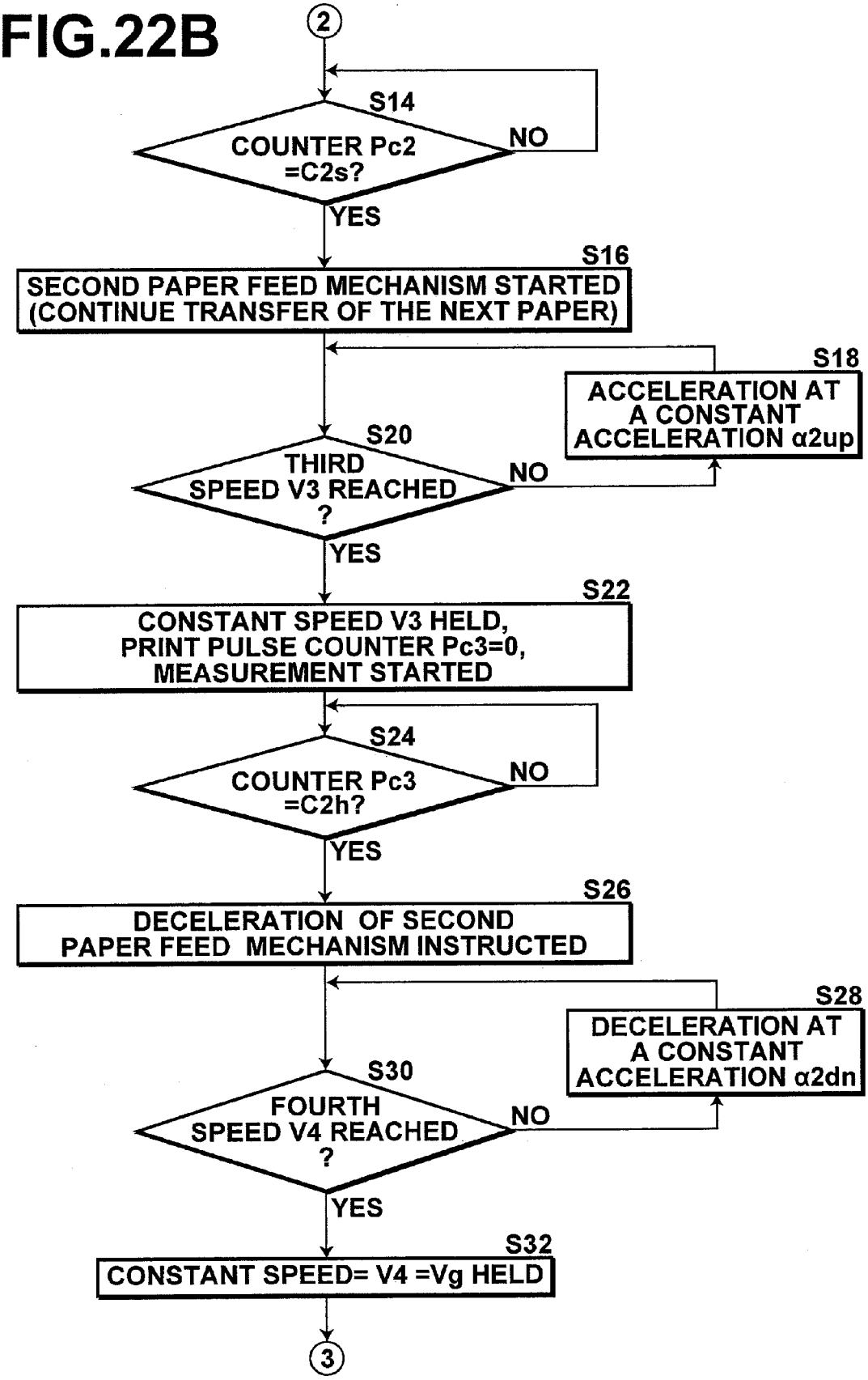
FIG. 22B is the other part of the flow chart showing in detail a method of controlling the second paper feed mechanism in the ink jet printer in accordance with the first embodiment.

A method of controlling the second paper feed mechanism 14 will be described in more detail, hereinbelow. FIGS. 22A and 22B show a flow chart showing in detail a method of controlling the second paper feed mechanism 14 in the ink jet printer in accordance with the first embodiment. FIG. 9 is also referred to if necessary.

Whether the trailing edge of the preceding paper is detected is first monitored through the paper edge detector 13 (S2). When the trailing edge of the preceding paper is detected by the paper edge detector 13 (time t1 in FIG. 9, downward movement of the detecting signal of the paper edge detector 13), the paper feed control section 15 starts measurement of the count Pc, as described above in the method of controlling the first paper feed mechanism 12, after resetting to 0 the counter Pc1 of the print pulse output from the paper transfer control section 23 (S4).

The paper feed control section 15 monitors the counter Pc1 (S6) and when the counter Pc1 reaches a preset C2*r* (time t2 in FIG. 9), the paper feed control section 15 starts measurement of the count Pc2 after resetting to 0 the counter Pc2 (S8). The C2*r* is the distance B of movement of the trailing edge of the paper 2 from the time when the leading edge of the preceding paper 2 is detected by the paper edge detector 13 to the time when the trailing edge thereof reaches the second paper feed mechanism 14 in terms of counts of the print pulse signals.

Then the paper feed control section 15 monitors the counter Pc1 (S10) and when the counter Pc1 reaches a preset Cn2H (time t2' in FIG. 9), the paper feed control section 15 decelerates the second paper feed drive motor 14*c* of the second paper feed mechanism 14 at a predetermined acceleration α2*dn* and stops the second paper feed mechanism 14 (S12). In the case of a paper where there is no paper transferred next, transfer of papers is terminated at S12.

When there is a next paper, the paper feed control section 15 monitors the counter Pc2 after S12 and when the counter Pc2 reaches a preset C2*s* (time t5 in FIG. 9) (S14), the paper feed control section 15 starts driving the second paper feed drive motor 14*c* and accelerates the same at a constant acceleration α2*up* until the transfer speed of the second paper feed mechanism 14 reaches the third speed V3 (S18, S20). At the time when the transfer speed of the second paper feed mechanism 14 reaches the third speed V3 (time t6 in FIG. 9), the paper feed control section 15 holds the constant speed and at the same time, resets the counter Pc3 to start monitoring the counter Pc3 (S22).

Then the paper feed control section 15 monitors the counter Pc3 (S24) and when the counter Pc3 reaches a C2*h* (time t7 in FIG. 9), the paper feed control section 15 decelerates the second paper feed drive motor 14*c* of the second paper feed mechanism 14 at a predetermined constant acceleration α2*dn* (S26, S28, S30). Then, the paper feed control section 15 holds the constant speed V4 when the transfer speed of the second paper feed mechanism 14 reaches the fourth speed V4 (time t8 in FIG. 9) and processing returns to S2. When the paper to be transferred is a first one, the processing is started from step (S14) of monitoring whether the counter Pc2 reaches the C2*s*.

The counts and the third speed V3 used in the above description of method of controlling the second paper feed mechanism 14 will be described, hereinbelow.

The Cn2H is a transfer distance H of the trailing edge of the paper 2 from the time when the trailing edge of the preceding paper 2 detected by the paper edge detector 13 to the time when the second paper feed drive motor 14*c* is started to be decelerated in terms of counts of the print pulse signals and accordingly a constant value irrespective of the paper transfer speed Vg in the image forming section 20. The transfer distance H is necessary to be set to a value in which the trailing edge of the paper 2 can be surely estimated to be passed by transfer rollers 14*a* and 14*b* of the second paper feed mechanism 14, and accordingly, margin of 7.5 [mm] is taken in this embodiment.

Accordingly, $$\begin{aligned} Cn2H &= (35.5(\text{distance } B) + 7.5[\text{mm}])/Gp \\ &= 42.8[\text{mm}]/84.667[\mu\text{m}] \\ &= 505 \end{aligned}$$

The C2*s* corresponds to a time from the time immediately after the trailing edge of the paper is passed by the transfer rollers 14*a* and 14*b* of the second paper feed mechanism 14 to the time at which the paper transfer by the second paper feed mechanism 14 is started which is obtained by multiplying a fixed time t=75 [ms] by the count and is in terms of the count.

Accordingly, $$C2s = 75\ [\text{ms}]/84.667\ [\mu\text{m}] \times Vg = 0.886 \times Vg$$

The C2*h* corresponds to a time from the time the at which the peripheral speed of the second paper feed motor 14*c* reaches the third speed V3 to the time at which the peripheral speed of the second paper feed motor 14*c* is started to decelerate to the fourth speed V4 which is obtained by multiplying a fixed time t=8 [ms] by the count and is in terms of the count.

Accordingly, the C2*h*=8 [ms]/84.667 [μm]×Vg=0.094×V

Further, in the ink jet printer of this embodiment, though the paper transfer speed Vg in the image forming section is set at 700 [mm/s], FIG. 13 shows a change of the value of Cn2H, C2*s* or C2*h* when the paper transfer speed Vg is changed. As described above, the Cn2H is a constant value 505 irrespective of the Vg, and the C2*s* and C2*h* are in proportion to the paper transfer speed Vg.

A method of calculating the third speed V3 will be described, hereinbelow. The third speed V3 is a factor necessary to increase the productivity (to reduce intervals between papers). Of course, the third speed V3 is higher than the fourth speed V4.

However, it is impossible to infinitely reduce intervals between papers, reducing intervals between papers must be in the range where no downstream function is adversely affected. Accordingly, it is necessary that detection of transfer jam in each section and/or discharge of papers in the paper discharge path should be suitably carried out as the downstream functions.

Accordingly, in this embodiment, since the transfer speed Vg in the image forming section is equal to 700 [mm/s] which is a maximum value of the ink discharge control that is a value over which the image formation cannot be in time, the third speed V3 is set so that the productivity of A4 lateral (160 [ppm]) is ensured. That is, since in order to ensure A4 lateral=210 mm, 160 [ppm], 700 [mm/s]/(160/60)=262.5 intervals between papers G should not be larger than 262.5-210=52.5. The intervals between papers G has been set at 40 mm inclusive of the margin in this embodiment.

The third speed V3 must be set to satisfy this condition. In the case of this embodiment, the papers can be transferred to the image forming section 20 at the intervals between papers G=40 mm if the third speed V3 is set at 1500 [mm/s] when the Vg is equal to 700 [mm/s].

Assuming that the above relation is a fixed ratio, the third speed V3 can be calculated to any transfer speed Vg in the image forming section 20 according to the following formula.

$$V3 = (1500/700) \times Vg\ [\text{mm/s}]$$

Further, the paper intervals can be calculated to any transfer speed Vg in the image forming section 20 according to the following formula.

$$G \approx (40\ [\text{mm}]/700\ [\text{mm/s}]) \times Vg[\text{mm/s}]$$

FIG. 15 is a graph showing changes of the third speed V3 when the paper transfer speed Vg in the image forming section is changed in the ink jet printer of this embodiment. As shown in FIG. 15, the paper transfer speed Vg in the image forming section is proportional to the third speed V3.

Further, the fourth speed V4 is equal to the paper transfer speed Vg in the image forming section 20.

Figure 23:
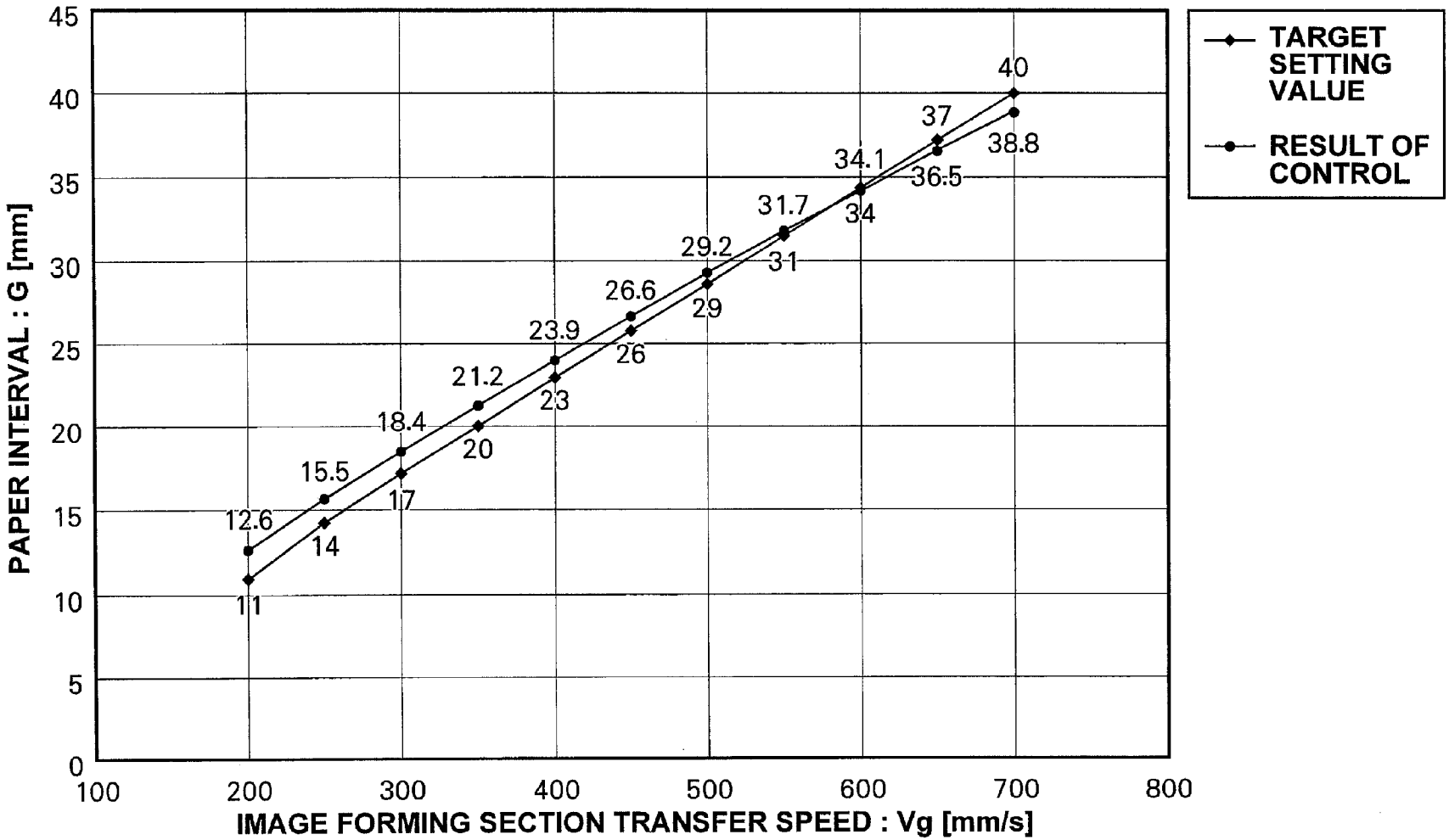
FIG. 23 is a graph showing target setting value of the paper interval G when the paper transfer speed Vg in the image forming section is changed and the paper interval G as a result of controlling the second paper feed mechanism by calculating the third speed V3 by the paper feed system of the present invention.

In the ink jet printer of this embodiment, since the third speed V3 is calculated in the manner described above, the paper transfer intervals G can be more narrowed and its productivity can be increased. FIG. 23 is a graph showing a target setting value of the paper interval G when the paper transfer speed Vg in the image forming section is changed and the paper interval G as a result of controlling the second paper feed mechanism 14 by actually calculating the third speed V3 in the manner described above.

The ink jet printer using a paper feed system in accordance with a second embodiment of the present invention will be described, hereinbelow. The ink jet printer using a paper feed system in accordance with a second embodiment of the present invention differs from the ink jet printer using a paper feed system in accordance with the first embodiment of the present invention in that a pair of paper edge detectors are provided and the other part is substantially the same as each other. Accordingly, the difference from the ink jet printer using a paper feed system in accordance with the first embodiment of the present invention will be mainly described, hereinbelow. Further, the elements analogous to those in the ink jet printer using a paper feed system in accordance with the first embodiment will be given the same reference numerals, hereinbelow.

Figure 24:
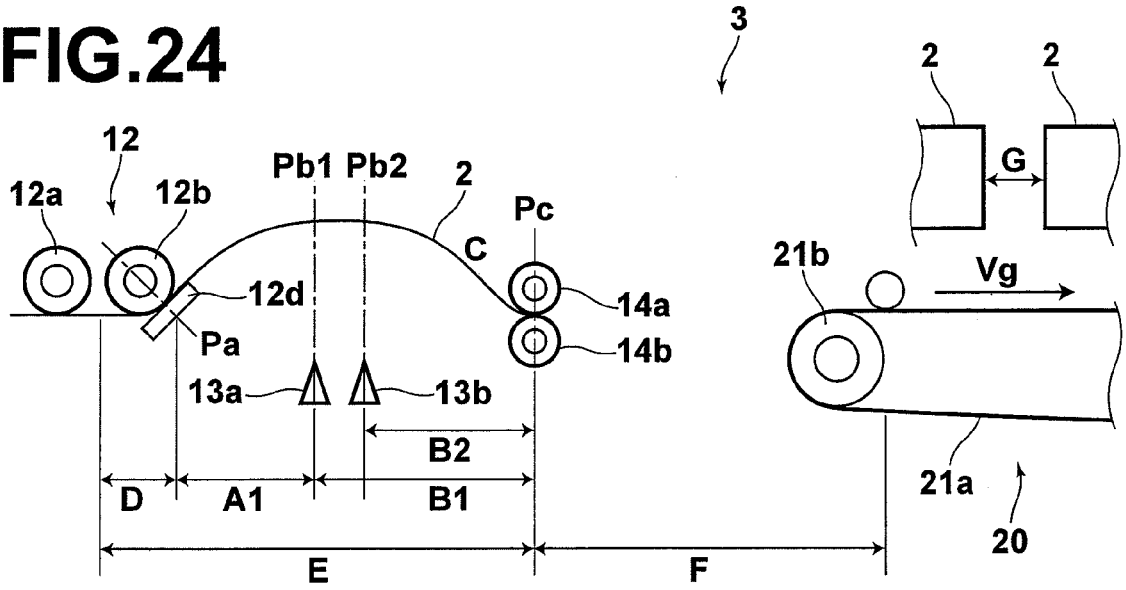
FIG. 24 is a view showing in detail the relative positions of a first paper feed mechanism, a paper edge detector, a second paper feed mechanism, and an image forming section which have been set in the ink jet printer using a paper feed system in accordance with a second embodiment of the present invention.

As shown in FIG. 24, the ink jet printer 3 of this embodiment comprises a pair of paper edge detectors, that is, a first edge detector 13*a* and a second edge detector 13*b*. The first and second edge detectors 13*a* and 13*b* are disposed between the first and second paper feed mechanisms 12 and 14 to respectively detect the leading and trailing edges of the papers transferred toward the second paper feed mechanism 14 from the first paper feed mechanism 12. Further, the arrangement of the image forming section is the same as the ink jet printer in accordance with the first embodiment shown in FIG. 1.

The control system of the ink jet printer 3 of this embodiment is substantially the same as that of the ink jet printer 1 of the first embodiment, but differs therefrom in that the paper feed control section 15 of the paper feed section 10 calculates the second paper transfer speed V2 in the first paper feed mechanism 12 on the basis of the detecting signals output from the first and second edge detectors 13*a* and 13*b* and controls the transfer speed of the first paper feed drive mechanism 12 on the basis of the detecting signals.

A method of controlling the first paper feed mechanism 12 in the ink jet printer 3 of this embodiment will be described, hereinbelow. FIG. 24 is a view showing in detail the relative positions of a first paper feed mechanism 12, first and second paper edge detectors 13*a* and 13*b*, a second paper feed mechanism 14, and an image forming section 20 which have been set in the ink jet printer using a paper feed system in accordance with a second embodiment of the present invention. A1, B1, B2, C to G and Vg shown in FIG. 24 have been set as follows.

Figure 25:
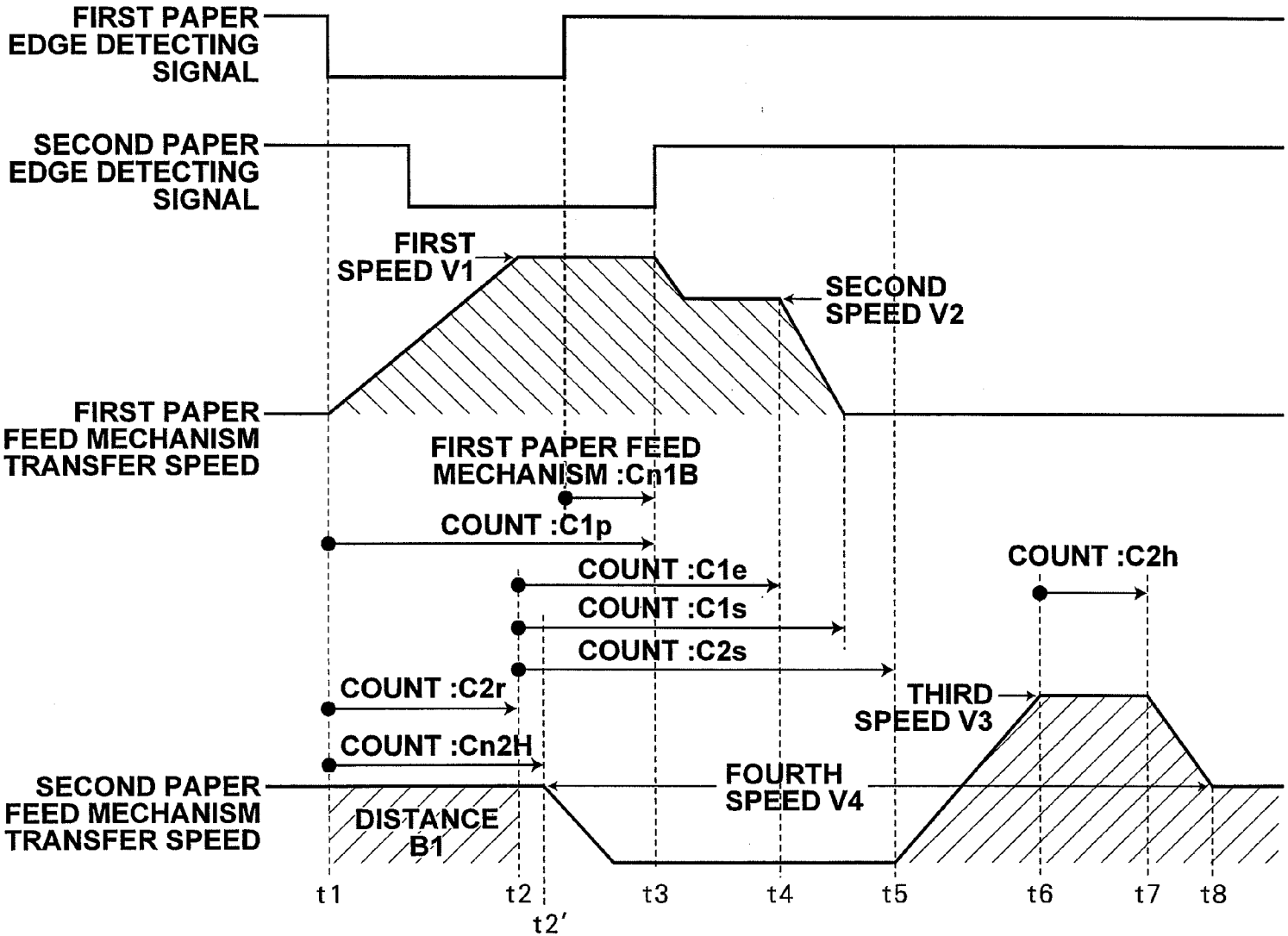
FIG. 25 is a timing chart showing the detecting signal generated by the paper edge detector, the change in the transfer speed of the first paper feed mechanism, the change in the transfer speed of the second paper feed mechanism and the count of the print pulse signals in the ink jet printer in accordance with the second embodiment.
Figure 26A:
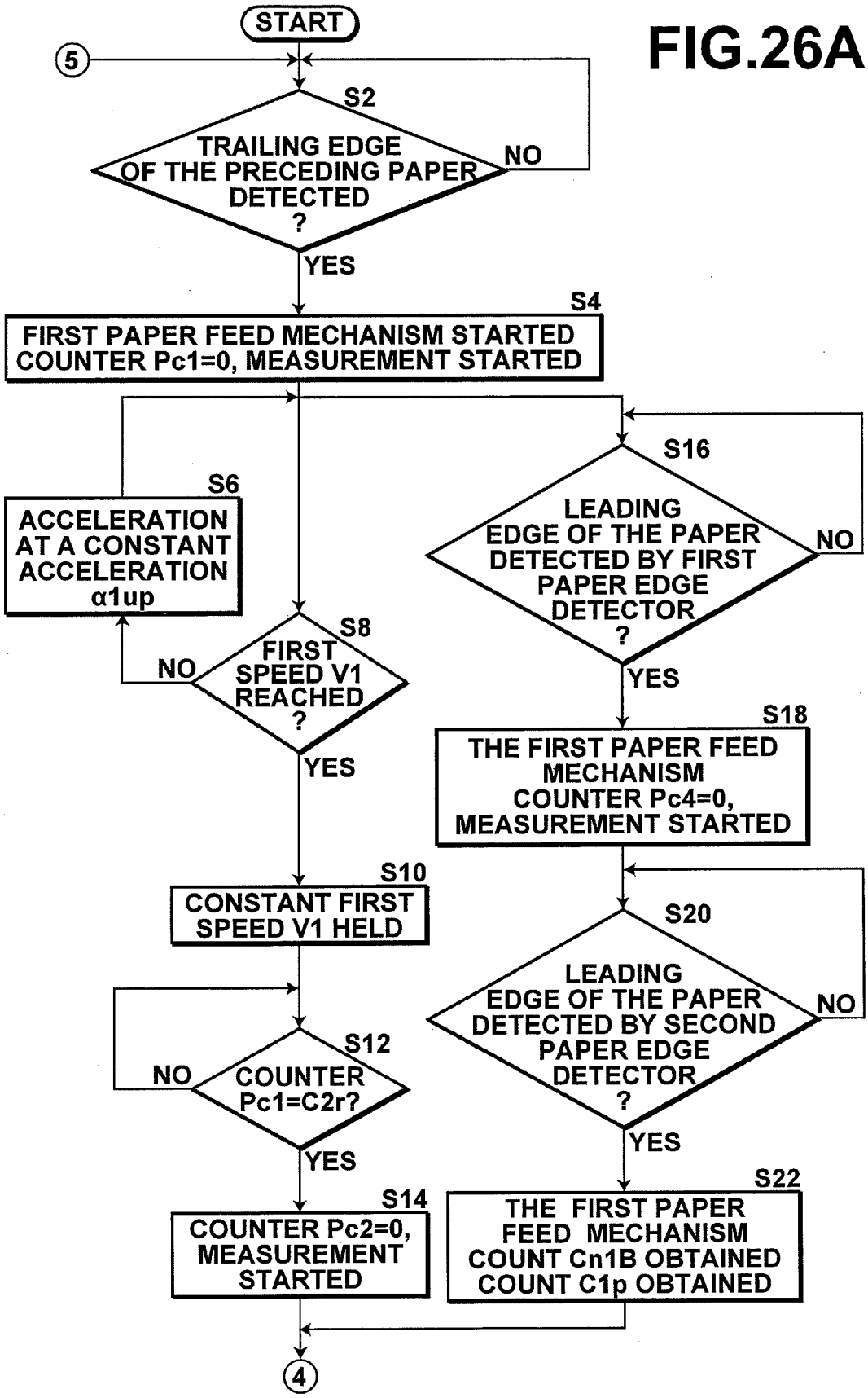
FIG. 26A is a part of a flow chart showing in detail a method of controlling the first paper feed mechanism in the ink jet printer in accordance with the second embodiment.
Figure 26B:
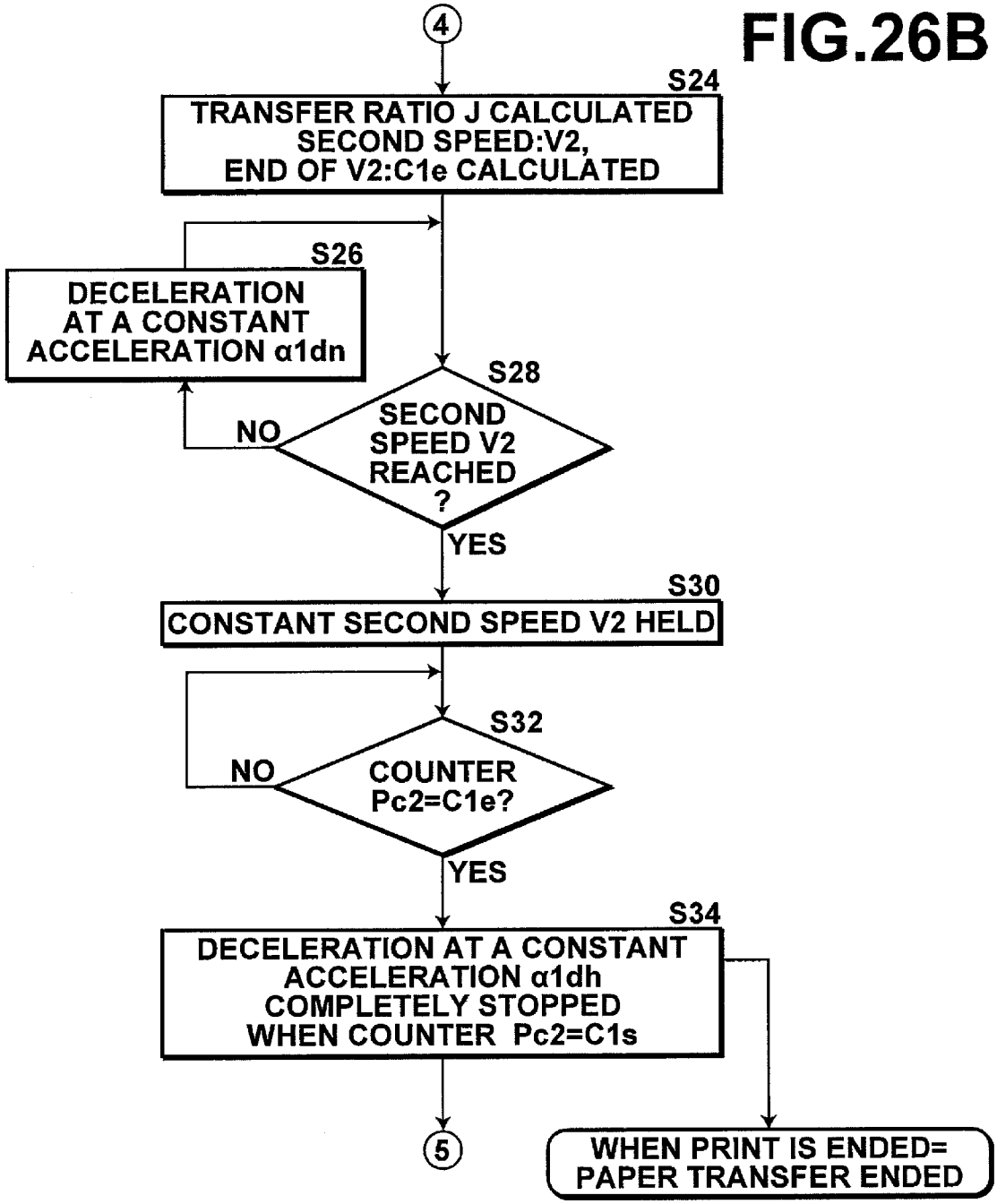
FIG. 26B is the other part of the flow chart showing in detail a method of controlling the first paper feed mechanism in the ink jet printer in accordance with the second embodiment.

A1: the distance from position Pa of the rubber roller 12*b* (at which the rubber roller 12*b* is in contact under a pressure with the separation plate 12*d*) to position Pb of the paper edge detector 13=43.7 mm B1: the distance from position Pb1 of the first paper edge detector 13*a* to the nipping position Pc of the transfer rollers 14*a* and 14*b*=40.3 mm B2: the distance from position Pb2 of the second paper edge detector 13*b* to the nipping position Pc of the transfer rollers 14*a* and 14*b*=30.3 mm C: the amount of sagging between the first and second paper feed mechanisms 12 and 14 (the amount of correction of the oblique running)=5 mm D: the margin for the waiting position of the papers (the uppermost position where the papers can be supplied)=16 mm E: the transfer distance of the first paper feed mechanism 12 (A+B+C+D)=105 mm F: the distance from the nipping position Pc of the transfer rollers 14*a* and 14*b* to the delivery position Pd to the image forming section 20=58 mm G: the paper interval (the distance between the trailing edge of the preceding paper and the leading edge of the next paper) in the image forming section 20=40 mm Vg: the paper transfer speed by the transfer belt 21*a* in the image forming section 20=700 mm/s FIG. 25 is a timing chart showing the detecting signal detected by the first paper edge detector 13*a*, the detecting signal detected by the second paper edge detector 13*b*, the change in the transfer speed of the first paper feed mechanism 12, and the change in the transfer speed of the second paper feed mechanism 14 in the ink jet printer in accordance with the second embodiment, and FIGS. 26A and 26B show a flow chart showing a method of controlling the first paper feed mechanism 12 in the ink jet printer in accordance with the second embodiment.

In the method of controlling the first paper feed mechanism 12 in accordance with this embodiment, whether there is detected by the first edge detector 13*a* the trailing edge of a paper transferred before is monitored (S2). When the trailing edge of the paper transferred before is detected by the first edge detector 13*a* (time t1 in FIG. 25; downward movement of the detecting signal of the first paper edge detector 13*a*), the paper feed control section 15 drives the first drive motor 12*c* of the first paper feed mechanism 12 to start the paper transfer and at the same time resets to 0 the counter Pc1 of the print pulse output from the paper transfer control section 23, thereby starting measurement of the counter Pc1(S4). It is assumed that the paper transfer means 21 has been started at this time and the paper transfer control section 23 outputs the print pulse generated by the rotary encoder 21*c* for the image forming section. In the case of a paper where there is no paper transferred previously, S4 is carried out at any timing.

The paper feed control section 15 accelerates the first paper feed drive motor 12*c* of the first paper feed mechanism 12 at a predetermined acceleration $\alpha$1*up* (S6, S8) so that the transfer speed of the first paper feed mechanism 12 reaches the preset first speed V1. Then when the transfer speed of the first paper feed mechanism 12 reaches the first speed V1, the paper feed control section 15 holds the speed (S10).

The counter Pc1 is monitored (S12) and measurement of the counter Pc2 is started after the counter Pc2 is reset to 0 when the counter Pc1 becomes a preset C2*r* (time t2 in FIG. 16) (S14).

After section S14, the paper feed control section 15 monitors whether the leading edge of the next paper is detected by the first paper edge detector 13*a* (S16) and when it is determined that the leading edge of the paper is detected by the first paper edge detector 13*a*, the paper feed control section 15 starts measurement of the counter Pc4 of the first paper feed mechanism 12 after resetting to 0 the counter Pc4 of the first paper feed mechanism 12 (S18). The counter Pc4 of the first paper feed mechanism 12 counts the pulse signals generated by rotary encoder 12*e* for the first paper feed mechanism 12. Then the paper feed control section 15 monitors whether the leading edge of the paper is detected by the second paper edge detector 13*b* (S20) and when the leading edge of the paper is detected by the second paper edge detector 13*b* (time t3 in FIG. 16), obtains the counts Pc1 of the counter Pc1 as the C1*p* and at the same time, and obtains the counts of the counter Pc4 for the first paper feed mechanism 12 as the counts Cn1B of the counter Pc4 for the first paper feed mechanism 12 (S22).

Then the paper feed control section 15 calculates the transfer ratio J of the first paper feed mechanism 12 by the use of the counts Cn1B of the first paper feed mechanism 12 obtained in the manner described above, and the second speed V2 by the use of the the C1*p* obtained in the manner described above and the transfer ratio J thus calculated and calculates the end C1*e* of the second speed V2 (S24). The method of calculating the second speed V2 and the C1*e* will be described in detail later. Further, the paper feed control section 15 determines that there is generated a paper transfer-error when the count of the C1*p* thus obtained is not smaller than a predetermined value and outputs a control signal to make an alarm sound representing that there is generated a paper transfer-error or an alarm display representing that there is generated a paper transfer-error.

Then the paper feed control section 15 decelerates the first paper feed drive motor 12*c* of the first paper feed mechanism 12 at a predetermined acceleration $\alpha$1*dn* (S26, S28) so that the transfer speed of the first paper feed mechanism 12 reaches the second speed V2. Then when the transfer speed of the first paper feed mechanism 12 reaches the second speed V2, the paper feed control section 15 holds the constant speed (S30).

Then the paper feed control section 15 monitors the counter Pc2 (S32) and when the counter Pc2 reaches the end C1*e* of the second speed V2 (time t4 in FIG. 16), the paper feed control section 15 decelerates the first paper feed drive motor 12*c* of the first paper feed mechanism 12 at a predetermined constant acceleration α1*dn* and stops the first paper feed drive motor 12*c* when the counter Pc2 reaches the C1*e* (S34).

In the case of a paper where there is a paper transferred next, the first paper feed mechanism 12 executes the processing represented by step 2 and the following steps, and in the case of a paper where there is no paper transferred next, the first paper feed mechanism 12 terminates the paper transfer.

Though, in the above description, the measurement of the counter Pc2 is started in S14 and the counter Pc2 is monitored whether it becomes the end C1*e* in S32 and whether it becomes the C1*s* in S34, it is not necessary to use the counter Pc2 but the counter Pc1 may be used to monitor whether the counter Pc1 becomes C2*r*+C1*e* in S32 and whether the counter Pc1 becomes C2*r*+C1*s* in S34.

The counts and the first and second speeds V1 and V2 used in the description of controlling the first paper feed mechanism 12 made above will be described, hereinbelow.

The C2*r* is the distance B of movement of the trailing edge of the paper 2 from the time when the leading edge of the preceding paper 2 is detected by the paper edge detector 13 to the time when the trailing edge thereof reaches the second paper feed mechanism 14 in terms of counts of the print pulse signals. Accordingly, it is a constant value irrespective of the paper transfer speed Vg of the image forming section 20. The ink jet printer 1 of this embodiment is 300 [dpi]=25.4 [mm]/300=84.667 [μm] in pixel density Gp. Accordingly, C2*r*=B1/Gp=40.3 [mm]/=84.667 [μm]=476.

Figure 27:
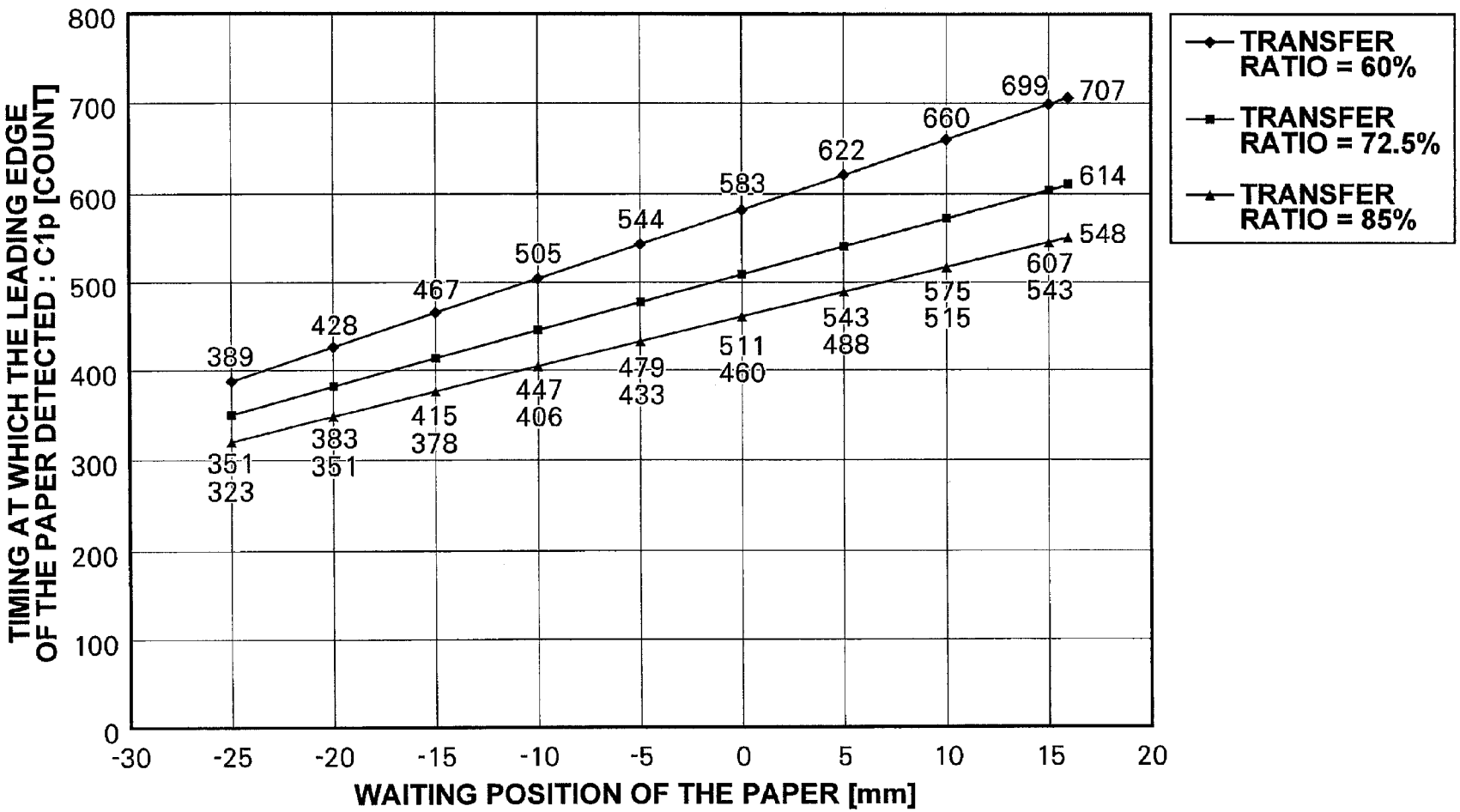
FIG. 27 is a graph showing a relation of C1*p*, the waiting position of the papers and the transfer ratio of the papers when the paper transfer speed Vg in the image forming section is 700 [mm/s]
Figure 28:
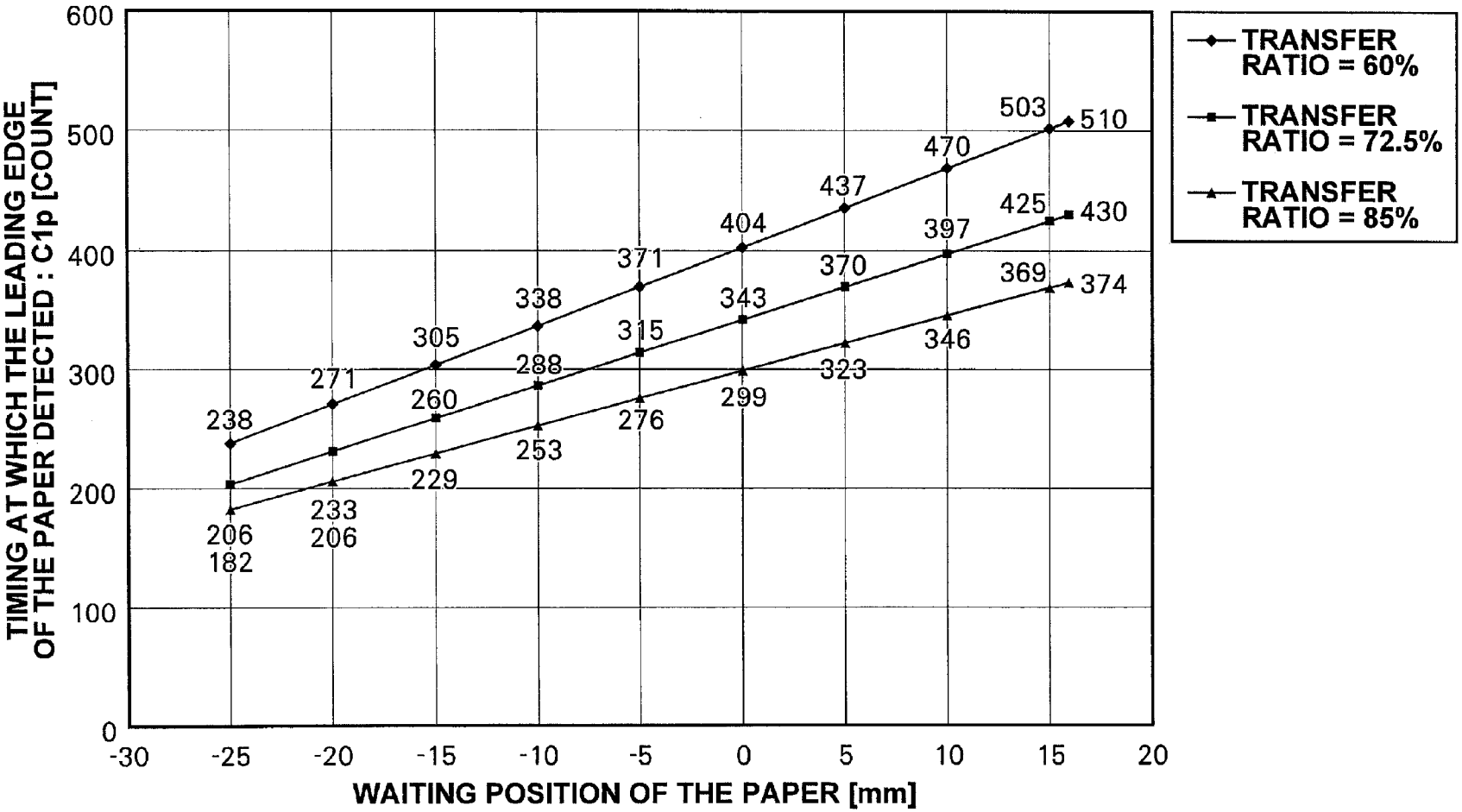
FIG. 28 is a graph showing a relation of C1*p*, the waiting position of the papers and the transfer ratio of the papers when the paper transfer speed Vg in the image forming section is 700 [mm/s]

C1*p* is a count from the time at which the paper transfer by the first paper feed mechanism 12 is started to a time at which the leading edge of the paper is detected and a value thereof depends on the waiting position and the transfer ratio of the papers. FIG. 27 is a graph showing a relation of C1*p*, a waiting position and the transfer ratio of the papers when the paper transfer speed Vg in the image forming section is 700 [mm/s] in the ink jet printer of this embodiment. The waiting position of the papers are represented by 0 in the case of the waiting position shown by Pa in FIG. 24 with those on the upstream side thereof represented by positive values and those on the downstream side thereof represented by negative values. As shown in FIG. 27, the value of the C1*p* is increased as the waiting position is on a more upstream side and as the paper transfer ratio is reduced. FIG. 28 is a graph showing a relation of C1*p*, a waiting position and the transfer ratio of the papers when the paper transfer speed Vg in the image forming section 20 is 350 [mm/s] in the ink jet printer of this embodiment.

The C1*s* corresponds to a time from the time immediately after the trailing edge of the paper is passed by the transfer rollers 14*a* and 14*b* of the second paper feed mechanism 14 to the time at which the paper transfer by the first paper feed mechanism 12 is stopped which is obtained by multiplying a time t=70 [ms] by the count and is in terms of the count of a fixed time. Since the time t can be represented as t=count×Gp/Vg, the formula according to which the time t is converted to the count is count=Vg×t/Gp. Accordingly, C1*s*=70 [ms]/84.667 [μm]×Vg=0.827×Vg.

Figure 29:
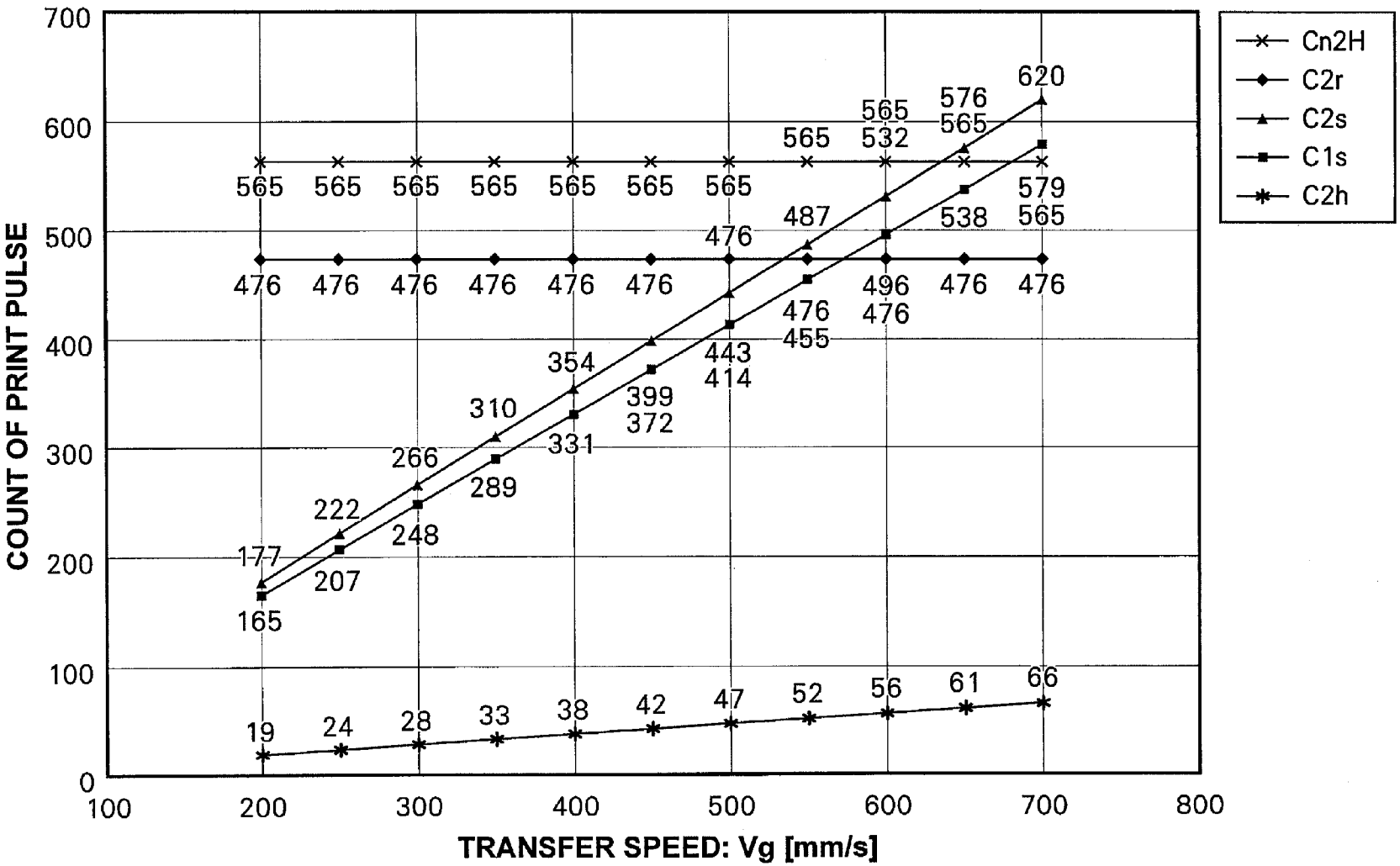
FIG. 29 is a graph showing a change of the value of Cn2H, C2*r*, C2*s*, C1*s*, and C2*h* when the paper transfer speed Vg in the image forming section is changed.

Further, though the transfer speed Vg by the second paper feed mechanism 14 in the image forming section is set at 700 [mm/s] in the ink jet printer of this embodiment, FIG. 29 is a graph showing a change of the value of C2*r* or C1*s*, when the paper transfer speed Vg is changed. The C2*r* is a constant value 476 irrespective of the Vg as described above. The C1*s* is in proportion to the Vg.

A method of calculating the first speed V1 will be described, hereinbelow. The first speed V1 is determined to deliver the papers to the second paper feed mechanism 14 under the conditions where the waiting position of the papers on the paper feed table 11 are in the most upstream side and the transfer ratio by the first paper feed mechanism 12 is minimum. By this, the conditions where the first speed V1 is not lower than the second speed V2 are set. Of course, the second speed V2 is equal to the first speed V1 at most.

The transfer distance E of the paper itself by the first paper feed mechanism 12 is A1+B1+C1+D1. Assuming that the minimum transfer ratio is 70%, the transfer distance E of the first paper feed mechanism 12 is E/0.7.

The concrete method of calculating the first speed V1 is as described above in the first embodiment and $$V1=\{b-\sqrt{(b^2-4a\cdot c)}\}/(2\cdot a)$$

$$\{1/(2\times\alpha 1up+1/(2\times\alpha 1dn)\}=a,\ \{(C2r+C1s)\times Gp/Vg\}=b,\ \{E/0.7\}=c$$

Figure 30:
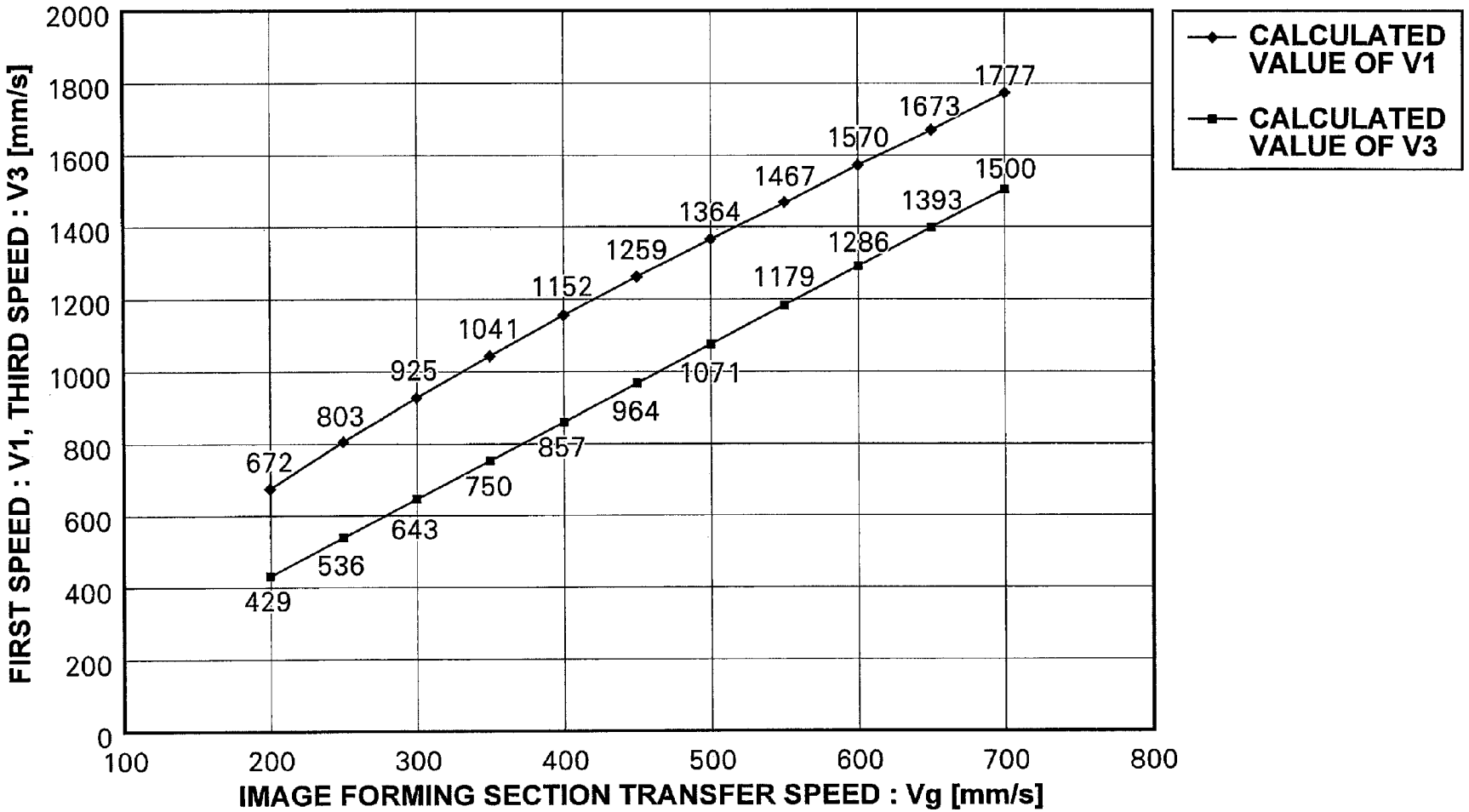
FIG. 30 is a graph showing changes of the first and third speeds V1 and V3 when the paper transfer speed Vg in the image forming section is changed.

The first speed V1 can be calculated in the manner described above. FIG. 30 is a graph showing change of the first speed V1 when the paper transfer speed Vg in the image forming section 20 is changed in the ink jet printer of this embodiment. As shown in FIG. 30, the first speed V1 is in proportion to the paper transfer speed Vg in the image forming section 20.

A method of calculating the second speed V2 will be described, hereinbelow. In order to calculate the second speed V2, that the area of the hatched portion in FIG. 16 should be equal to the transfer distance of the paper by the first paper feed mechanism 12 from when the leading edge of the paper is detected to when the first paper feed mechanism 12 is stopped is used. The transfer distance of the paper itself from when the leading edge of the paper is detected by the second edge detector 13*b* to when the first paper feed mechanism 12 is stopped is B2+C. Accordingly, when it is assumed that the central transfer ratio of the paper by the first paper feed mechanism 12 is 0.75 and the transfer ratio of the paper by the first paper feed mechanism 12 is J, the transfer distance of the paper by the first paper feed mechanism 12 from when the leading edge of the paper is detected to when the first paper feed mechanism 12 is stopped (B2+C)/J.

The concrete method of calculating the second speed V2 is as described above in the first embodiment and $$(B2+C)/J=t_3\times V1/2+t_5\times V2$$

Accordingly, $$V2=\{(B2+C)/J-V1^2/2\times\alpha 1dn\}/\{(C2r+C1s-C1p)\times Gp/Vg-V1/\alpha 1dn\}$$

The transfer ratio J is represented by the following formula assuming that the distance by which the paper is actually moved between the first and second paper edge detector 13*a* and 13*b* is 10 [mm] and the transfer distance of the paper by the first paper feed mechanism 12 is Ln1B [mm].

$$J=10/Ln1B=10/(0.154\times Cn1B)$$

wherein 0.154 is the transfer distance per one pulse of the rotary encoder 12*e* for the first paper feed mechanism 12 and is calculated according to the following formula.

$$49\ [\text{mm}] \times n/(2.5 \times 400\ [\text{ppr}]) = 0.154\ [\text{mm/pulse number}]$$

wherein the pulse number of the rotary encoder 12*e* for the first paper feed mechanism 12 is 400 [ppr], transfer ratio of the output shaft of the first paper feed drive motor 12*c* and the rubber rollers 12*a* and 12*b* thereof is 1:2.5 and the diameter of the rubber rollers 12*a* and 12*b* is 49 [mm].

Figure 31:
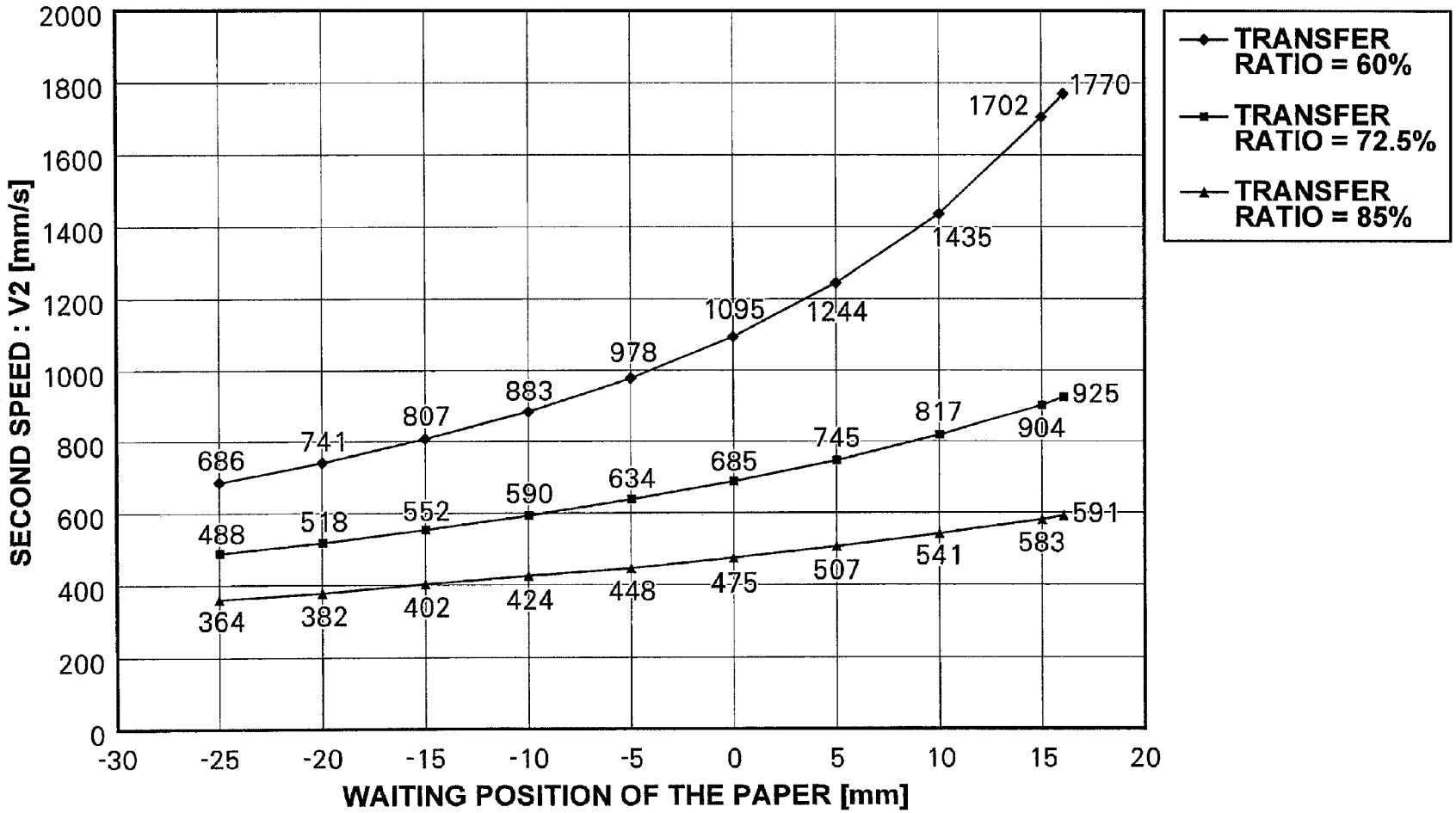
FIG. 31 is a graph showing a relation of the second speed V2 and the waiting position of the papers when the paper transfer speed Vg in the image forming section is 700 [mm/s]
Figure 32:
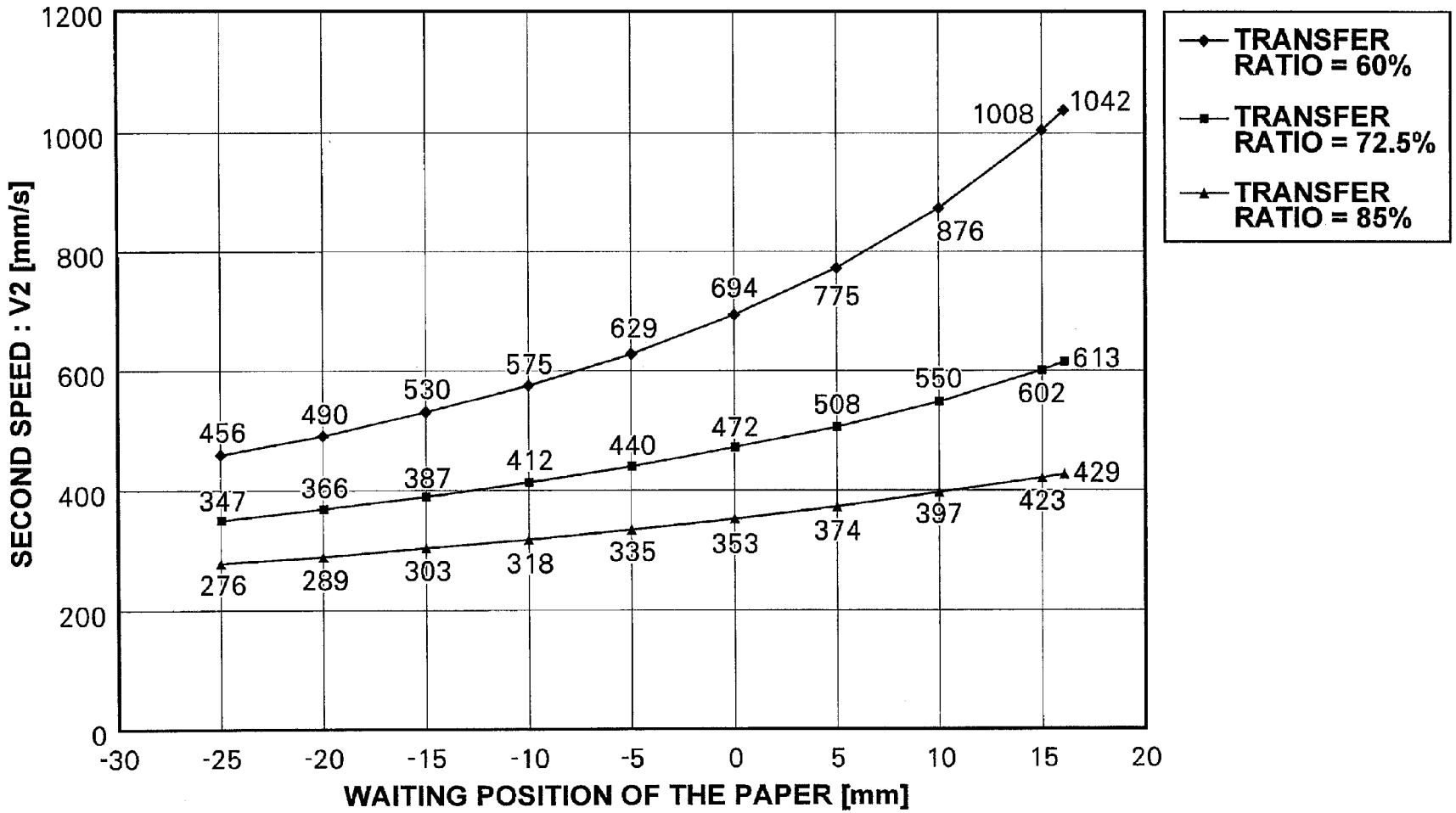
FIG. 32 is a graph showing a relation of the second speed V2 and the waiting position of the papers when the paper transfer speed Vg in the image forming section is 350 [mm/s]

The second speed V2 can be obtained according to the manner described above. Though the second speed V2 is changed depending on the waiting position of the paper, FIG. 31 is a graph showing a relation of the second speed V2 and the waiting position of the paper. In FIG. 31, the second speed V2 is obtained assuming that the paper transfer speed Vg in the image forming section is 700 [mm/s], The waiting position of the papers are represented by 0 in the case of the waiting position shown by Pa in FIG. 24 with those on the upstream side thereof represented by positive values and those on the downstream side thereof represented by negative values. In FIG. 31, the second speed V2 is obtained assuming that the transfer ratio J is 72.5%, 60% or 85%. As shown in FIG. 31, the second speed V2 is increased as the waiting position is on a more upstream side and as the paper transfer ratio of the first paper feed mechanism 12 is reduced. FIG. 32 is a graph showing the second speed V2 when the paper transfer speed Vg in the image forming section is 350 [mm/s].

The method of calculating the end C1*e* of the second speed V2 by the use of the calculated second speed V2 is the same as in the first embodiment and $$C1e = C1s - (V2/\alpha 1dn)Vg/Gp$$

Figure 33:
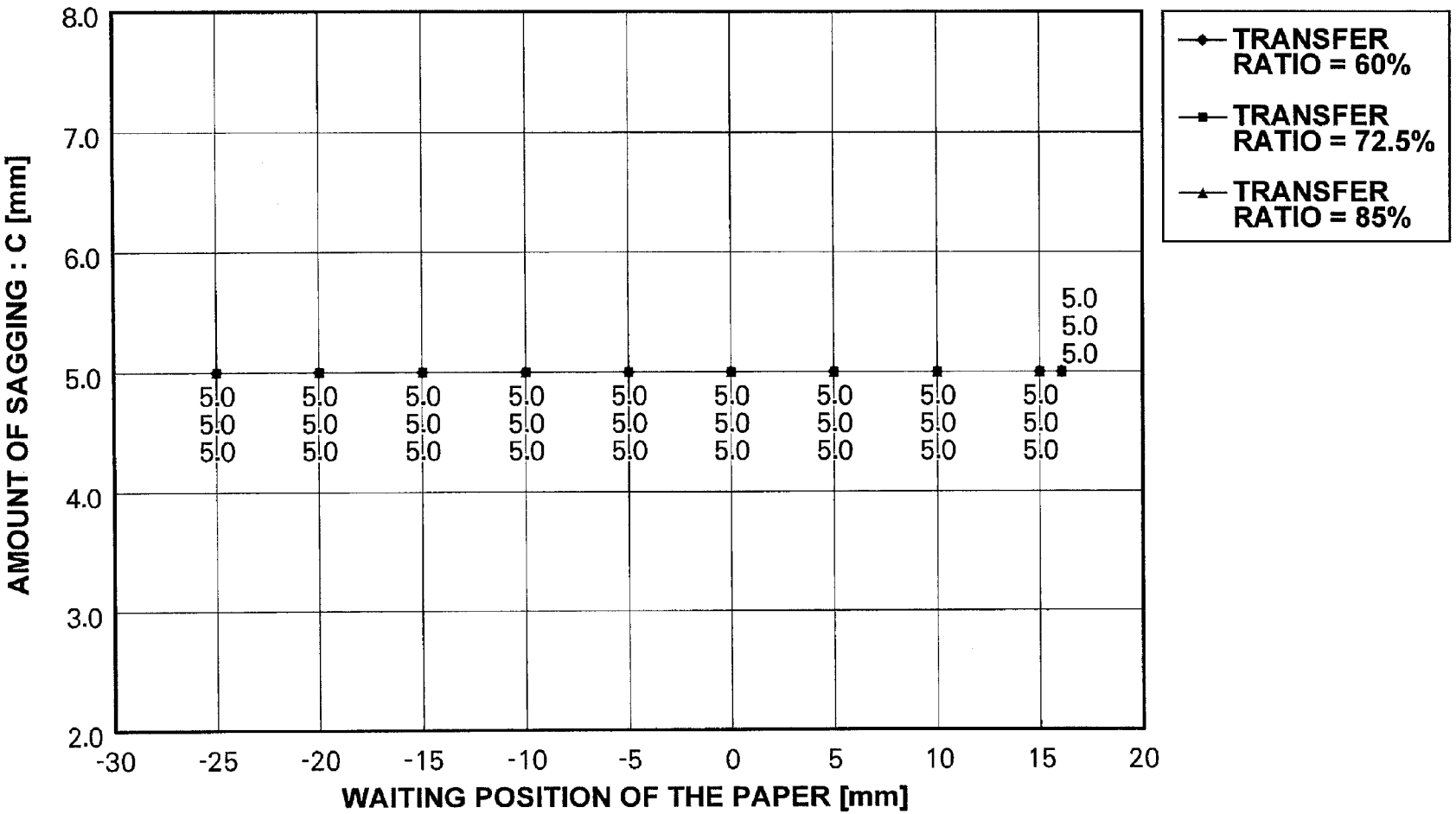
FIG. 33 is a graph showing a relation of the waiting position of the papers and the amount of sagging when the first paper feed mechanism is controlled in accordance with the second embodiment of the present invention.
Figure 34:
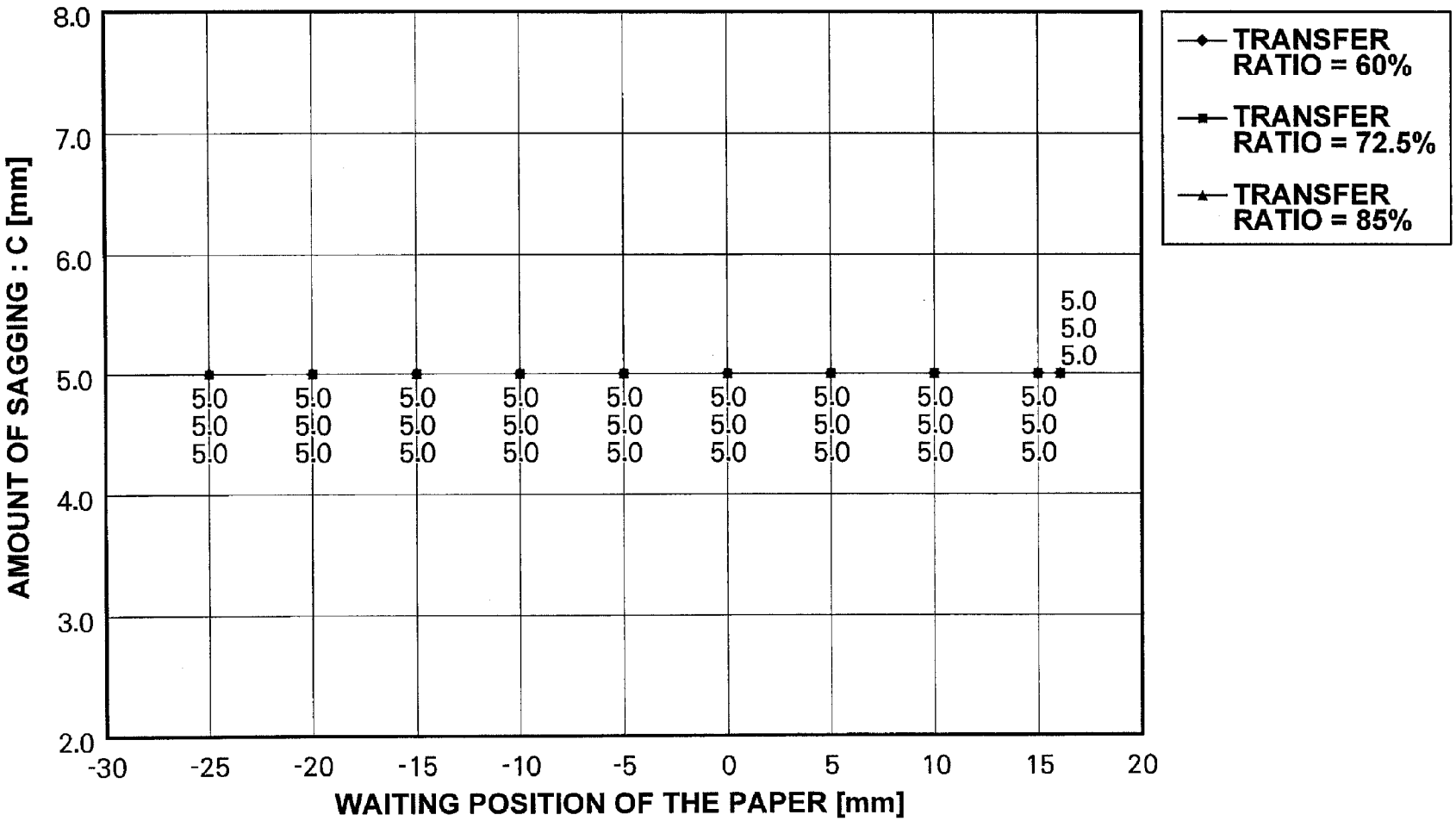
FIG. 34 is a graph showing a relation of the waiting position of the papers and the amount of sagging when the first paper feed mechanism is controlled in accordance with the second embodiment of the present invention.

In the ink jet printer of this embodiment, since the second speed V2 and the count C1*e* at which the second speed V2 is ended are determined according to the timing at which the leading edge of the paper is detected by the paper edge detector, as shown in FIG. 33, the amount of sagging described above can be held constant irrespective of the waiting positions of the papers. Further in the ink jet printer of this embodiment, since the second speed V2 and the count C1*e* are calculated by calculating the transfer ratio J of the first paper feed mechanism 12 and taking into account the calculated transfer ratio J, the amount of sagging can be a target designed constant value 5 mm irrespective of the transfer ratio J of the first paper feed mechanism 12. That is, though, in the ink jet printer of the first embodiment, the amount of sagging of the paper is changed due to change in the transfer ratio of the paper upon change of, e.g., the quality of the paper, the amount of sagging can be held constant even if the transfer ratio of the paper changes in the ink jet printer of the second embodiment. Though FIG. 33 shows the amount of sagging when the paper transfer speed Vg in the image forming section is 700 [mm/s], FIG. 34 shows the amount of sagging when the paper transfer speed Vg in the image forming section is 350 [mm/s]. As shown in FIGS. 33 and 34, the amount of sagging when the paper transfer speed Vg in the image forming section is 350 [mm/s] does not differ from when the paper transfer speed Vg in the image forming section is 700 [mm/s].

Further in the ink jet printer of the second embodiment, the second paper feed mechanism 14 may be controlled as in the first embodiment and is controlled as shown by the flow chart shown in FIGS. 22A and 22B.

However, the count used in the method of controlling the second paper feed mechanism 14 in the second embodiment differs from that used in the first embodiment.

The C2*r* is the distance B1 of movement in terms of counts of the print pulse signals and C2*r*=B1/Gp=40.3 [mm]/=84.667 [μm]=476.

The Cn2H is a transfer distance H of the trailing edge of the paper 2 from the time when the trailing edge of the preceding paper 2 is detected by the paper edge detector 13 to the time when the second paper feed drive motor 14*c* is started to be decelerated in terms of counts of the print pulse signals and accordingly a constant value irrespective of the paper transfer speed Vg in the image forming section 20. The transfer distance H is necessary to be set to a value in which the trailing edge of the paper 2 can be surely estimated to be passed by transfer rollers 14*a* and 14*b* of the second paper feed mechanism 14, and accordingly, a margin of 7.5 [mm] is taken in this embodiment.

Accordingly, $$\begin{aligned} Cn2H &= (40.3(\text{distance } B1) + 7.5[\text{mm}])/Gp \\ &= 47.8[\text{mm}]/84.667[\mu\text{m}] \\ &= 565 \end{aligned}$$

C2*s* and C2*h* are the same in the first embodiment described above.

Though, in the ink jet printer of this embodiment, the paper transfer speed Vg in the image forming section is 700 [mm/s], FIG. 29 is a graph showing a change of the value of Cn2H, C2*s*, and C2*h* when the paper transfer speed Vg in the image forming section is changed. The Cn2H is a constant value 565 irrespective of the Vg as described above. The C2*s* and C2*h* are in proportion to the Vg.

The method of calculating the third and fourth speeds V3 and V4 is the same as in the first embodiment. FIG. 30 shows change of the third speed V3 when the paper transfer speed Vg in the image forming section is changed in the ink jet printer of this embodiment. As shown in FIG. 30, the third speed V3 is in proportion to the paper transfer speed Vg in the image forming section.

Figure 35:
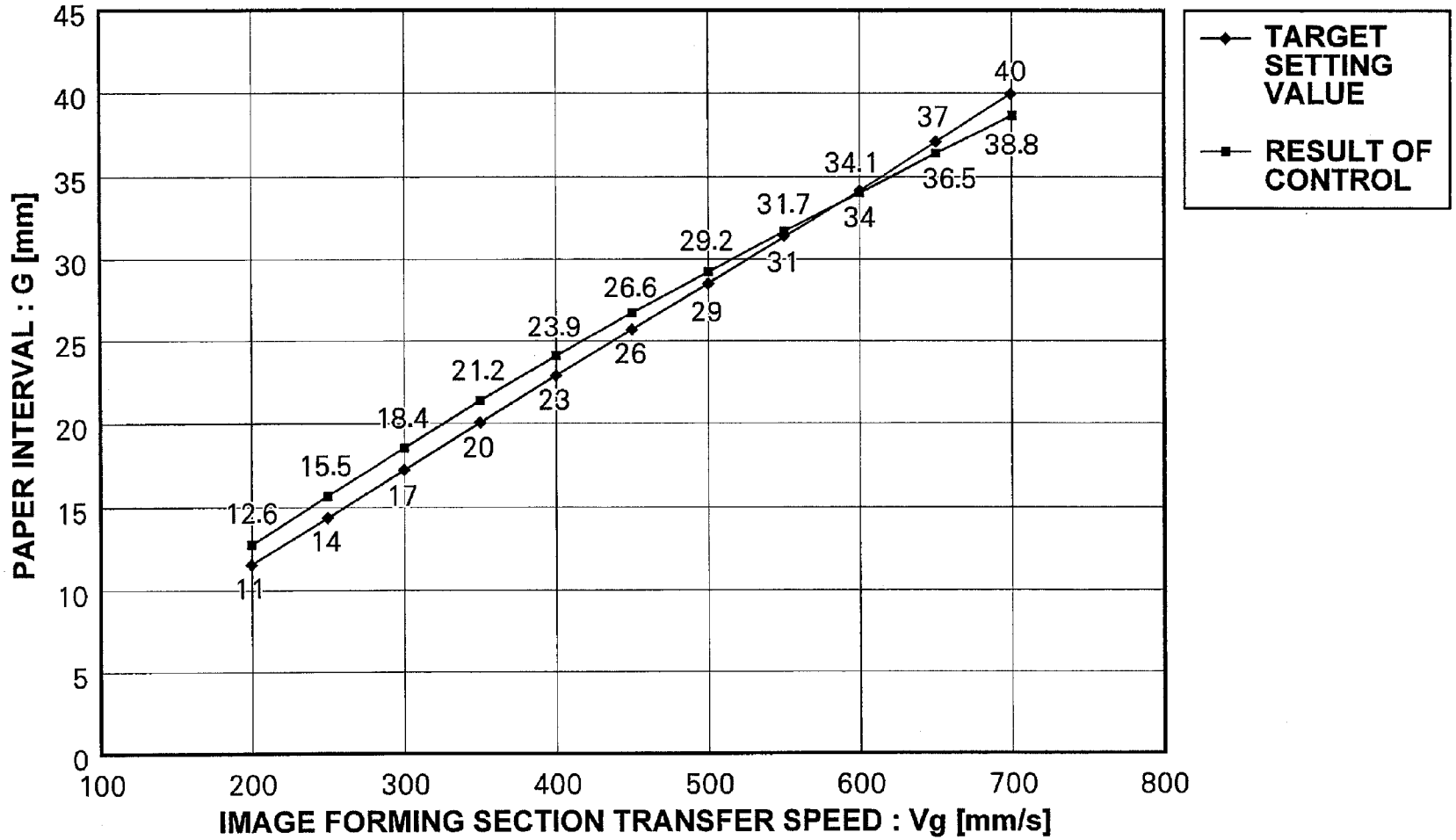
FIG. 35 is a graph showing target setting value of the paper interval G when the paper transfer speed Vg in the image forming section is changed and the paper interval G as a result of controlling the second paper feed mechanism by calculating the third speed V3 by the paper feed system of the present invention.

In the ink jet printer of this embodiment, since the third speed V3 is calculated and set in the manner described above, the paper interval G can be more narrowed and its productivity can be increased. FIG. 35 shows target setting value of the paper interval G when the paper transfer speed Vg in the image forming section is changed and the paper interval G as a result of controlling the second paper feed mechanism 14 by actually calculating the third speed V3 in the manner described above.

Though in the above description, the first and second embodiments of the present invention have been described on the ink jet printer, the paper feed system of the present invention can be applied to the stencil printing system.

What is claimed is:

1. A paper feed system comprising a first paper feed mechanism which takes out and transfers one by one a plurality of papers placed on a paper feed table in a stack and a second paper feed mechanism which transfers the papers transferred by the first paper feed mechanism to an image forming section at a predetermined timing, a paper edge detector being provided between the first and second paper feed mechanisms to detect an edge of the paper, and a paper feed control section which controls the first paper feed mechanism to transfer the papers at a first speed and then at a second speed not higher than the first speed when the paper edge detector detects the leading edge of the paper, the second speed being determined on the basis of the timing at which the leading edge of the paper is detected, and for varying the second speed according to the timing at which the leading edge of the paper is detected, such that a uniform amount of sag across substantially a length of the papers is imparted to the papers that abut the second paper feed mechanism.

2. A paper feed system as defined in claim 1 in which the paper feed control section controls the second paper feed mechanism to transfer the paper at a third speed for a predetermined time interval and then at a fourth speed equal to the paper transfer speed in the image forming section, the third speed being higher than the fourth speed.

3. A paper feed system as defined in claim 1 in which the paper feed control section controls the first paper feed mechanism to start transferring a next paper from a time at which the trailing edge of a preceding paper transferred by the second paper feed mechanism is detected by the paper edge detector.

4. A paper feed system as defined in claim 1 in which the paper feed control section stops the second paper feed mechanism from a predetermined time after a time at which a trailing edge of a preceding paper transferred by the second paper feed mechanism passes by the second paper feed mechanism to a time at which the transfer of a next paper by the first paper feed mechanism is ended.

5. A paper feed system as defined in claim 1 in which the paper feed control section controls the first and second paper feed mechanisms to start the transfer of a next paper by the second paper feed mechanism from a predetermined time after a time at which the transfer of the paper by the first paper feed mechanism is ended.

6. A paper feed system as defined in claim 1 in which the image forming section comprises an image forming pulse generating means which generates a pulse signal according to transfer of the paper in the image forming section and the paper feed control section measures the time at which the paper edge detector detects a leading edge of the paper on the basis of the pulse signal output from the image forming pulse generating means.

7. A paper feed system as defined in claim 6 in which the paper feed control section controls the timing at which the first and second paper feed mechanisms are driven on the basis of the count of the pulse signals generated from the image forming pulse generating means.

8. A paper feed system as defined in claim 6 in which the pulse signals generated from the image forming pulse generating means is a print pulse signal for controlling a printing timing in the image forming section.

9. A paper feed system as defined in claim 6 in which the paper feed control section determines that there is generated a paper transfer-error when the count of the pulse signals generated from the image forming pulse generating means is not smaller than a predetermined value at the time when the paper edge detector detects a leading edge of the paper.

10. A paper feed system as defined in claim 1, wherein the first speed is set based on a transfer initiation timing of the second paper feed mechanism, which is set in advance.

11. A paper feed system as defined in claim 1, wherein the second speed is set based on a transfer initiation timing of the second paper feed mechanism, which is set in advance.

12. A paper feed system as defined in claim 2, wherein the third speed is set based on intervals among the papers, which are set in advance, and the fourth speed.

* * * * *